US012385356B2

(12) United States Patent
Wiesenborn et al.

(10) Patent No.: US 12,385,356 B2
(45) Date of Patent: Aug. 12, 2025

(54) SYSTEMS AND METHODS FOR DOWNHOLE SERVICE TOOLS

(71) Applicant: Schlumberger Technology Corporation, Sugar Land, TX (US)

(72) Inventors: Robert Kyle Wiesenborn, Richmond, TX (US); Matthew Dresel, Sugar Land, TX (US); Pierre-Olivier Gourmelon, Houston, TX (US); Rex Mennem, Missouri City, TX (US); Matthew Billingham, Paris (FR); Todor Sheiretov, Houston, TX (US); Nathan Landsiedel, Sugar Land, TX (US); Yoann Couble, Houston, TX (US); Wade DuPree, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 387 days.

(21) Appl. No.: 18/065,930

(22) Filed: Dec. 14, 2022

(65) Prior Publication Data

US 2023/0115832 A1 Apr. 13, 2023

Related U.S. Application Data

(63) Continuation of application No. 16/649,478, filed as application No. PCT/US2018/052171 on Sep. 21, 2018, now Pat. No. 11,536,107.

(Continued)

(51) Int. Cl.

| | |
|---|---|
| ***E21B 34/14*** | (2006.01) |
| ***E21B 29/06*** | (2006.01) |
| ***E21B 41/00*** | (2006.01) |

(52) U.S. Cl.

CPC ..... *E21B 34/14* (2013.01); *E21B 41/0085* (2013.01); *E21B 29/06* (2013.01); *E21B 2200/06* (2020.05)

(58) Field of Classification Search

CPC ..... E21B 1/16; E21B 1/38; E21B 6/06; B25D 16/003; B25D 17/06; B25D 17/24

See application file for complete search history.

(56) References Cited

U.S. PATENT DOCUMENTS

| | | | |
|---|---|---|---|
| 1,030,992 | A | 7/1912 | Fulmer |
| 2,160,150 | A | 5/1939 | Jimerson |

(Continued)

FOREIGN PATENT DOCUMENTS

| | | | |
|---|---|---|---|
| CN | 101012746 | A | 8/2007 |
| CN | 102102510 | A | 6/2011 |

(Continued)

OTHER PUBLICATIONS

International Search Report and Written Opinion issued in the PCT Application PCT/US2022/042166 dated Dec. 9, 2022, 12 pages.

(Continued)

*Primary Examiner* — Cathleen R Hutchins

(74) *Attorney, Agent, or Firm* — Jeffrey D. Frantz

(57) ABSTRACT

A mechanical service tool that may include one or more anchors, a cutter, a communication and control system, and one or more sensors, as well as methods for operating the mechanical service tool, are provided. The one or more anchors may extend radially from the mechanical service tool and the cutter may move relative to the mechanical service tool. The cutter may include a drilling bit. The communication and control system may obtain remote commands that control the cutter, the one or more anchors, or both. The one or more sensors may detect operational conditions of the mechanical service tool and may be (Continued)

operatively coupled to the communication and control system.

19 Claims, 18 Drawing Sheets

Related U.S. Application Data

(60) Provisional application No. 62/561,414, filed on Sep. 21, 2017.

(56) References Cited

U.S. PATENT DOCUMENTS

| | | | | |
|---|---|---|---|---|
| 2,500,402 | A | 3/1950 | Craig | |
| 2,588,408 | A | 3/1952 | O leary | |
| 2,713,992 | A | 7/1955 | Snyder | |
| 3,167,122 | A | 1/1965 | Lang | |
| 3,225,828 | A | 12/1965 | Wisenbaker | |
| 4,325,436 | A | 4/1982 | Richter et al. | |
| 5,069,282 | A | 12/1991 | Taylor | |
| 5,170,843 | A | 12/1992 | Taylor | |
| 5,695,015 | A | 12/1997 | Barr | |
| 5,706,896 | A | 1/1998 | Tubel | |
| 5,785,120 | A | 7/1998 | Smalley et al. | |
| 5,832,998 | A | 11/1998 | Decker et al. | |
| 5,842,149 | A * | 11/1998 | Harrell | E21B 44/02 702/9 |
| 5,899,268 | A | 5/1999 | Lynde et al. | |
| 6,024,166 | A | 2/2000 | McGarian et al. | |
| 6,851,475 | B2 | 2/2005 | Simpson et al. | |
| 6,868,901 | B2 | 3/2005 | Mason et al. | |
| 7,575,056 | B2 | 8/2009 | Fuhst et al. | |
| 7,762,028 | B2 | 7/2010 | Valentz et al. | |
| 7,909,100 | B2 | 3/2011 | Bryant, Jr. et al. | |
| 8,789,598 | B1 | 7/2014 | Mlcak et al. | |
| 10,415,314 | B2 * | 9/2019 | Kartha | E21B 6/02 |
| 10,683,719 | B2 | 6/2020 | Motland | |
| 2003/0234121 | A1 | 12/2003 | Taylor et al. | |
| 2005/0092494 | A1 | 5/2005 | McElroy et al. | |
| 2005/0092495 | A1 | 5/2005 | Evans | |
| 2005/0150693 | A1 | 7/2005 | Madden | |
| 2006/0169456 | A1 | 8/2006 | Evans | |
| 2006/0207796 | A1 | 9/2006 | Stewart | |
| 2007/0084637 | A1 | 4/2007 | Orban et al. | |
| 2007/0151732 | A1 | 7/2007 | Clemens et al. | |
| 2008/0087424 | A1 | 4/2008 | McLaughlin | |
| 2010/0258293 | A1 | 10/2010 | Lynde et al. | |
| 2011/0209872 | A1 | 9/2011 | McAfee et al. | |
| 2011/0297380 | A1 | 12/2011 | Alberty et al. | |
| 2012/0029702 | A1 | 2/2012 | Tverlid | |
| 2012/0043089 | A1 | 2/2012 | Hoffman et al. | |
| 2014/0124191 | A1 | 5/2014 | Hallundbæk | |
| 2014/0311729 | A1 | 10/2014 | Pasvandi | |
| 2014/0360784 | A1 | 12/2014 | Hunziker | |
| 2015/0167394 | A1 | 6/2015 | Xia et al. | |
| 2015/0376966 | A1 | 12/2015 | Balasubramanian et al. | |
| 2016/0032696 | A1 | 2/2016 | Caccialupi et al. | |
| 2016/0130904 | A1 | 5/2016 | Andersen | |
| 2016/0258254 | A1 | 9/2016 | Guo et al. | |
| 2017/0175475 | A1 | 6/2017 | Kartha et al. | |
| 2018/0274298 | A1 * | 9/2018 | McMillan | E02D 7/26 |
| 2019/0063214 | A1 | 2/2019 | Castillo | |
| 2020/0332615 | A1 | 10/2020 | Wiesenborn | |

FOREIGN PATENT DOCUMENTS

| | | | |
|---|---|---|---|
| CN | 106194158 | A | 12/2016 |
| CN | 106687242 | A | 5/2017 |
| EP | 2813665 | A1 | 12/2014 |
| GB | 2129350 | A | 5/1984 |
| RU | 2315177 | C1 | 1/2008 |
| WO | 03069116 | A1 | 8/2003 |
| WO | 2010085154 | A1 | 7/2010 |
| WO | 2012054445 | A2 | 4/2012 |
| WO | 2012074755 | A3 | 8/2012 |
| WO | 2016028155 | A1 | 2/2016 |
| WO | 2016085490 | A1 | 6/2016 |

OTHER PUBLICATIONS

Office Action issued in U.S. Appl. No. 17/823,757 dated May 2, 2023, 20 pages.
Rejection Decision issued in China Patent Application No. 201880075070.X dated Jun. 30, 2023, 17 pages.
International Search Report and Written Opinion issued in PCT Application PCT/US2018/052171 dated Jan. 17, 2019 (18 pages).
International Search Report and Written Opinion issued in PCT Application PCT/US2018/052164 dated Mar. 6, 2019 (12 pages).
International Preliminary Report on patentability issued in PCT Application PCT/US2018/052171 dated Apr. 2, 2020 (15 pages).
International Preliminary Report on patentability issued in PCT Application PCT/US2018/052164 dated Apr. 2, 2020 (8 pages).
Partial Supplementary Search Report of European Patent Application No. 18858532.7 dated May 18, 2021, 11 pages.
Extended Search Report of European Patent Application No. 18858532.7 dated Oct. 4, 2021, 10 pages.
Search Report of Chinese Patent Application No. 201880075070X dated Nov. 10, 2021, 7 pages with English Translation.
Substanative Exam issued in Saudi Arabian Patent Application No. 520411583 dated Mar. 29, 2022, 11 pages with English translation.
Second Office Action issued in Chinese Patent Application No. 201880075070.X datd Jun. 15, 2022, 9 pages with English translation.
Substantive Examination Report issued in Saudi Arabian Patent Application No. 520411583 dated Sep. 26, 2022, 10 pages with English translation.
Office Action issued in U.S. Appl. No. 16/649,478 dated Oct. 18, 2021, 9 pages.
Office Action issued in U.S. Appl. No. 16/649,478 dated Apr. 4, 2022, 17 pages.
Notice of Allowance issued in U.S. Appl. No. 16/649,478 dated Sep. 23, 2022, 8 pages.
Third Office Action issued in Chinese Patent Application No. 201880075070.X dated Oct. 21, 2022, 11 pages with English translation.

* cited by examiner

SYSTEMS AND METHODS FOR DOWNHOLE SERVICE TOOLS

CROSS REFERENCE PARAGRAPH

This application is a Continuation of U.S. application Ser. No. 16/649,478, filed Mar. 20, 2020, which is a National Stage Entry of PCT/US2018/052171, filed Sep. 21, 2018, which claims the benefit of U.S. Provisional Application No. 62/561,414, entitled "SYSTEMS AND METHODS FOR DOWNHOLE SERVICE TOOLS," filed Sep. 21, 2017, the disclosure of which is are hereby incorporated herein by reference.

BACKGROUND

This disclosure relates to systems and methods for performing mechanical operations within a wellbore and/or a casing using downhole mechanical service tools.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Producing hydrocarbons from a wellbore drilled into a geological formation is a remarkably complex endeavor. In many situations, a casing may be disposed within the wellbore to assist in transporting hydrocarbons from within the geological formation to a collection facility at the surface of the wellbore. In other situations, the casing may be used to isolate and/or protect delicate systems within the casing from physical damage (e.g., abrasion, exposure to corrosive wellbore fluids) due to contact with the geological formation. However, there may be times where it is desirable to gain access behind the casing in certain specific locations.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one example, a mechanical service tool includes one or more anchors, a cutter, a communication and control system, and one or more sensors. The one or more anchors extend radially from the mechanical service tool. The cutter moves relative to the mechanical service tool and includes a drilling bit. The communication and control system obtains remote commands that control the cutter, the one or more anchors, or both. The one or more sensors detect operational conditions of the mechanical service tool and are operatively coupled to the communication and control system.

In another example, a method includes disposing a mechanical service tool within a casing of a wellbore, fastening the mechanical service tool to an interior surface of the casing through one or more anchors, extending a cutter comprising a drilling bit from the mechanical service tool, and machining the interior surface of the casing using the cutter.

In another example, an anchor of a mechanical service tool includes an actuator, a caliper, and a power unit. The caliper includes a friction pad that contacts an interior surface of a wellbore casing. The power unit extends the actuator from the anchor towards the interior surface of the casing.

In another example, a method includes disposing a mechanical service tool within a casing of a wellbore, extending an actuator of an anchor of the mechanical service tool, and moving a caliper towards an interior surface of the casing using the actuator.

In another example, an impact system of a mechanical service tool includes at least one shaft, an impact weight, a spring, a hammer mechanism, and a drilling bit. The at least one shaft is coupled to a driving motor. The impact weight is disposed within a housing of the mechanical service tool and the at least one shaft extends through an opening of the impact weight. The spring is coupled to the impact weight and the housing, and coils about an axis. The hammer mechanism engages or disengages the at least one shaft from the driving motor. The drilling bit is coupled to the at least one shaft of the mechanical service tool.

In another example, a method includes rotating at least one shaft of an impact system using a driving motor and winding a spring about an axis. The at least one shaft is disposed within a central portion of the spring. The method additionally includes unwinding the spring about the axis and accelerating an impact weight of the impact system. Furthermore, the method includes decelerating the impact weight and imposing a force on a drilling bit.

In another example, a jar tool of a mechanical service tool includes a threaded rod disposed within a tool body, a spring, and a hammer assembly. The threaded rod moves an anvil in a first direction to a first position within the jar tool. The spring applies a first force on the anvil in a second direction. The hammer assembly moves the anvil in the second direction towards a second position within the jar tool to generate a second force in the second direction that loosens the mechanical service tool from an obstruction within a casing.

In another example, a method includes disposing a jar tool within a casing of a wellbore, moving an anvil of the jar tool to a first position in a first direction, tensioning a spring coupled to the anvil to apply a first force to the anvil in a second direction, and moving the anvil in the second direction towards a second position to generate a second force in the second direction that loosens the mechanical service tool from an obstruction within the casing.

In another example, a patching tool of a mechanical service tool includes a threaded rod disposed within a patching sleeve, a shuttle coupled to the threaded rod, and a nose cone configured to guide the patching tool through a casing. The threaded rod couples to a driving motor that rotates the threaded rod. The shuttle couples to the threaded rod and moves axially along the threaded rod to expand the patching sleeve. The patching sleeve contacts an interior surface of the casing. The nose cone has a chamfered interior edge that guides the patching tool through the casing and reduces a risk of the patching tool catching the patching sleeve after the patching sleeve has expanded.

In another example, a method includes disposing a patching tool within a casing, rotating a threaded rod using a driving motor to move a shuttle, and expanding a patching sleeve within the casing when the threaded rod moves the shuttle from a first position to a second position.

In another example, a rotary cutter tool of a mechanical service tool includes one or more centralizing arms, one or more cutting arms, a cutter coupled to each cutting arm, and control electronics. The one or more centralizing arms radially extend from the rotary cutter tool and contact an interior surface of a casing. The one or more cutting arms radially extend from the rotary cutter tool and machine the interior surface of the casing. The control electronics obtains remote commands to control the centralizing arms, the cutting arms, and/or the cutter.

In another example, a method includes disposing a rotary cutter tool within a casing of a wellbore, centralizing the rotary cutter tool within the casing using one or more centralizing arms, extending one or more cutters from the rotary cutter tool towards an interior surface of the casing, and machining the interior surface of the casing using the one or more cutters.

In another example, a flow control device of a mechanical service tool includes a stationary member including a first slot, a floating element disposed circumferentially inward of the stationary member, and a prime mover disposed circumferentially inward of the floating element. The stationary member contacts an interior surface of a casing. The floating element includes a second slot and rotates about a central axis. The prime mover is coupled to the mechanical service tool, the mechanical service tool rotates the prime mover about the central axis, and the prime mover rotates the floating element about the central axis.

In another example, a method includes disposing a flow control device within a casing of a wellbore, anchoring a mechanical service tool to the casing, rotating a prime mover about a central axis using the mechanical service tool, rotating a floating element using the prime mover, and regulating a flow of fluid entering the casing.

In another example, a mechanical charging tool of a mechanical service tool includes an input shaft, a generator, and one or more output leads. The input shaft is rotated by a motor unit of the mechanical service tool. The generator converts rotational energy of the input shaft to electrical energy. The one or more output leads transfer the electrical energy to one or more components of the mechanical service tool.

In another example, a method includes disposing a mechanical charging tool within a casing of a wellbore; rotating an input shaft of the mechanical charging tool using a mechanical service tool, rotating a generator using the input shaft, generating electrical energy using the generator, and transmitting the electrical energy to the mechanical service tool using one or more leads of the mechanical charging tool.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 1:
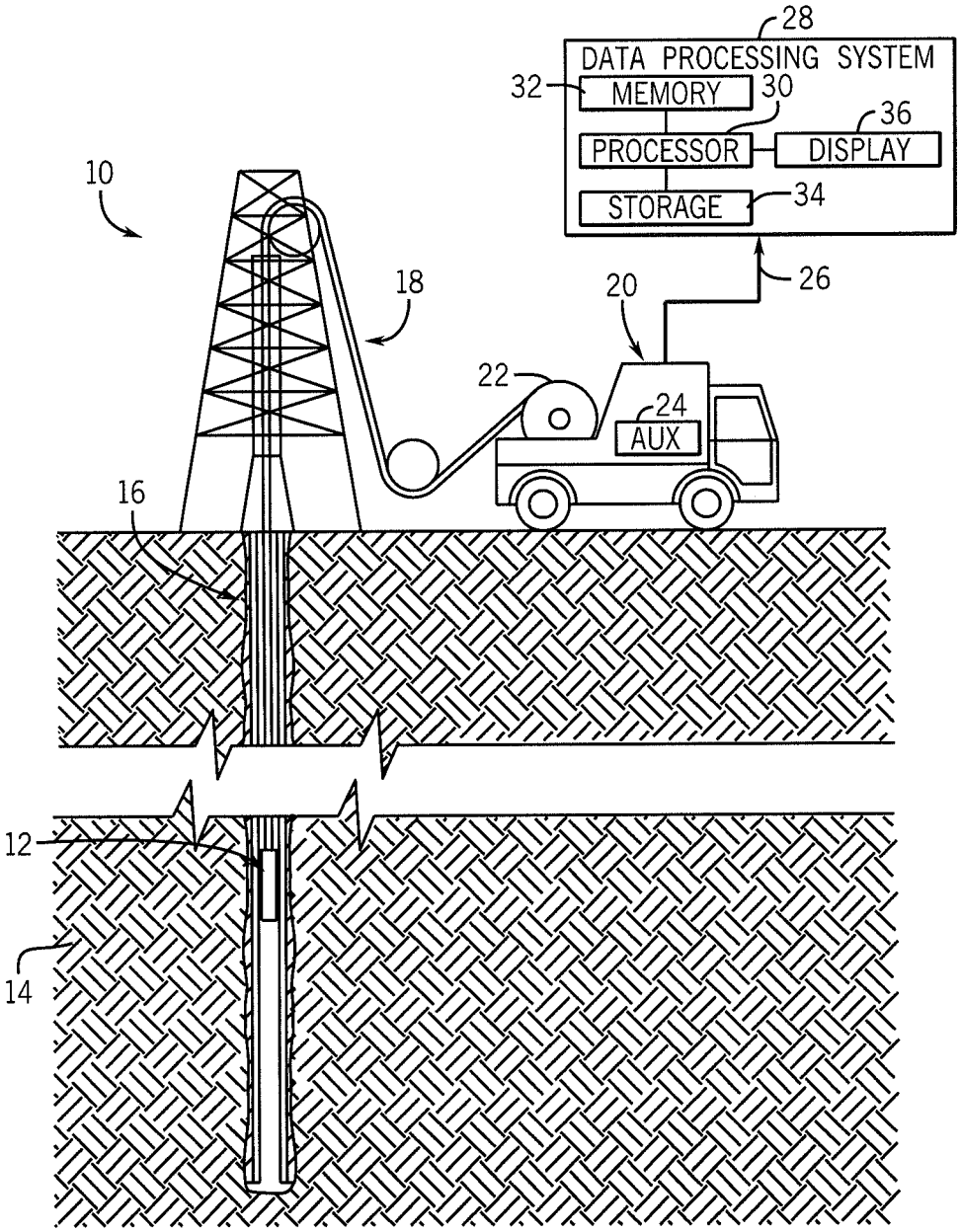
FIG. 1 is a schematic diagram of a wellbore logging system and cable that may obtain data measurements and move a mechanical service tool along a length of the wellbore, in accordance with an embodiment of the present disclosure.

With this in mind, FIG. 1 illustrates a well-logging system 10 that may employ the systems and methods of this disclosure. The well-logging system 10 may be used to convey a downhole tool (e.g., a mechanical service tool 12) or a dummy weight through a geological formation 14 via a wellbore 16. The mechanical service tool 12 may be conveyed on a cable 18 via a logging winch system 20. Although the logging winch system 20 is schematically shown in FIG. 1 as a mobile logging winch system carried by a truck, the logging winch system 20 may be substantially fixed (e.g., a long-term installation that is substantially permanent or modular). Any suitable cable 18 for well logging may be used. The cable 18 may be spooled and unspooled on a drum 22 and an auxiliary power source 24 may provide energy to the logging winch system 20 and/or the mechanical service tool 12.

The mechanical service tool 12 may perform various mechanical operations (e.g., machining operations) within the wellbore 16 and/or may provide logging measurements 26 to a data processing system 28 via any suitable telemetry (e.g., via electrical or optical signals pulsed through the geological formation 14 or via mud pulse telemetry). The data processing system 28 may process the logging measurements. The logging measurements 26 may include certain properties of the mechanical service tool 12 (e.g., location, orientation) that may indicate the operational status of the mechanical service tool 12.

To this end, the data processing system 28 thus may be any electronic data processing system that can be used to carry out the systems and methods of this disclosure. For example, the data processing system 28 may include a processor 30, which may execute instructions stored in memory 32 and/or storage 34. As such, the memory 32 and/or the storage 34 of the data processing system 28 may be any suitable article of manufacture that can store the instructions. The memory 32 and/or the storage 34 may be ROM memory, random-access memory (RAM), flash memory, an optical storage medium, or a hard disk drive, to name a few examples. A display 36, which may be any suitable electronic display, may provide a visualization, a well log, or other indication of properties in the geological formation 14 or the wellbore 16 using the logging measurements 26.

Figure 2:
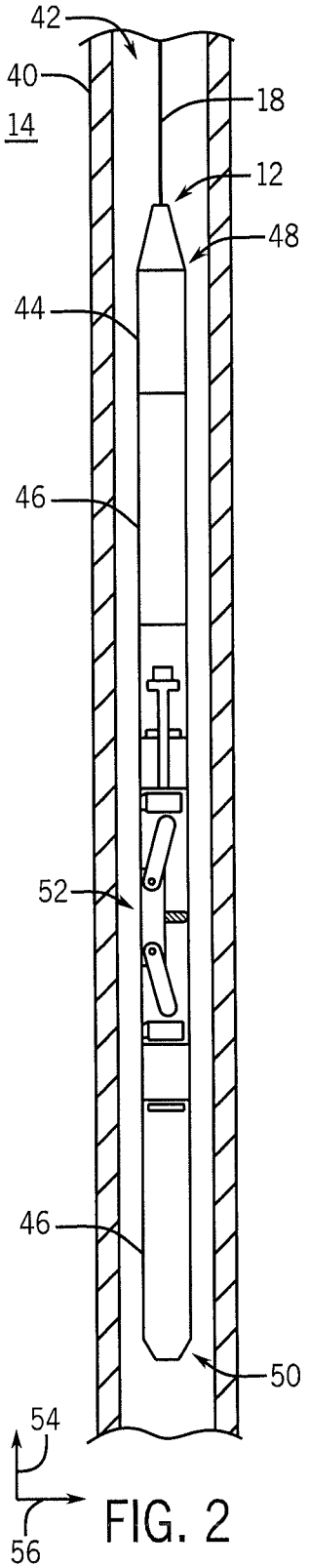
FIG. 2 is a perspective view of the mechanical service tool of FIG. 1, which illustrates subcomponents of the mechanical service tool, in accordance with an embodiment of the present disclosure.

The mechanical service tool 12 may be used to perform a variety of downhole machining operations. Turning now to FIG. 2, an embodiment of the mechanical service tool 12 is shown disposed within a casing 40 of the wellbore 16. The casing 40 may serve to isolate an interior region 42 of the wellbore 16 from the geological formation 14. In another embodiment, the mechanical service tool 12 may be disposed directly within the wellbore 16 without the casing 40. As described in more detail herein, the mechanical service tool 12 may be used to perform various mechanical operations (e.g., milling, grinding, cutting) within the casing 40 and/or against the formation 14 along the wall of the wellbore 16. With the foregoing in mind, it may be useful to first describe one embodiment of the mechanical service tool 12. The mechanical service tool 12 may include a tool body 44, which may couple to one or more anchors 46 and/or additional subcomponents. The mechanical service tool 12 may include an upper end portion 48 and a lower end portion 50. A cutter mechanism 52 may be disposed between the upper end portion 48 and the lower end portion 50 of the mechanical service tool 12. The cutter mechanism 52 may be used to perform the mechanical operations (e.g., machining, grinding, cutting) on the casing 40. To facilitate further discussion, the mechanical service tool 12 and its subcomponents may be described with reference to a longitudinal 54 axis or direction, and a radial 56 axis or direction.

Figure 3:
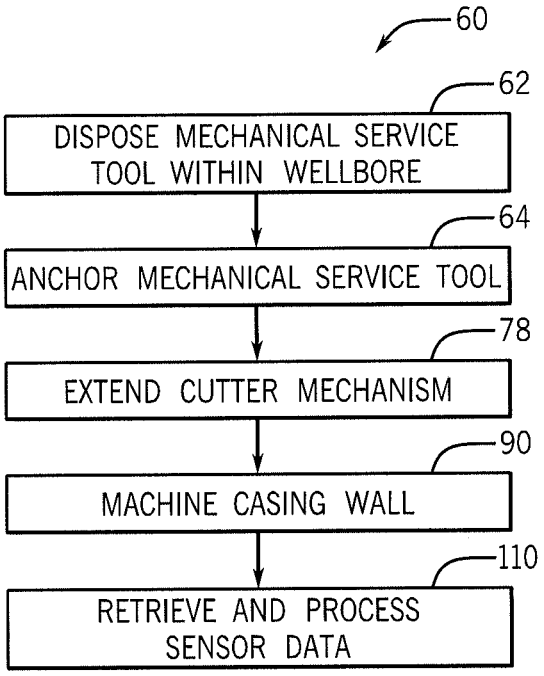
FIG. 3 is a method of operating the mechanical service tool of FIG. 2, in accordance with an embodiment of the present disclosure.

A method 60 may be used to operate the mechanical service tool 12 and/or carry out the mechanical operations set forth above, as shown in FIG. 3. Block 62 relates to FIG. 2 discussed above, in which the mechanical service tool 12 may be raised or lowered into the wellbore 14 via the cable 18. The machining operations may include various portions (e.g., individual machining processes), embodiments of which are shown in FIGS. 4-11. The portions may be executed in a different order than presented in FIGS. 4-11. Additionally or otherwise, the machining operations may include additional portions or fewer portions than those shown in FIGS. 4-11.

Figure 4:
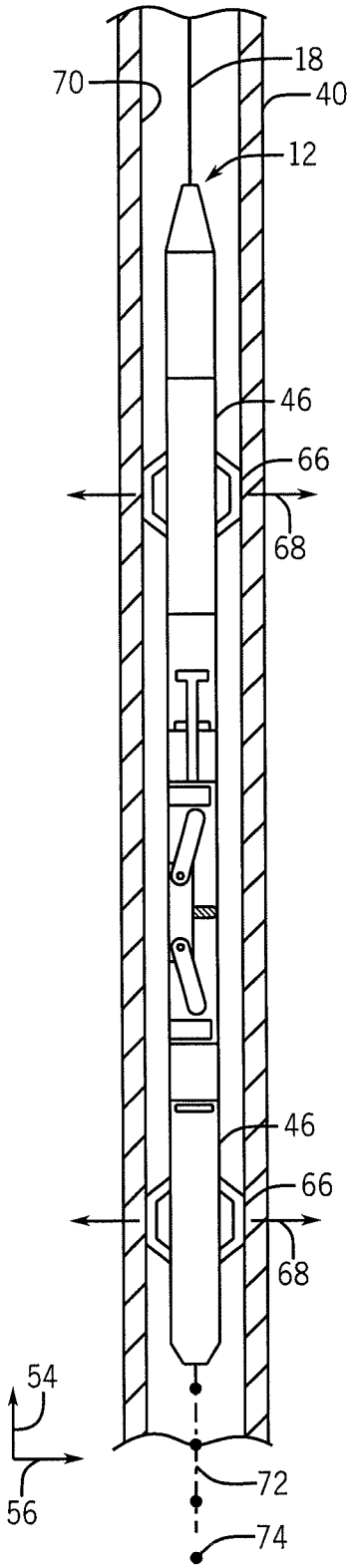
FIG. 4 is a perspective view of the mechanical service tool of FIG. 2, which illustrates anchors coupled to the mechanical service tool, in accordance with an embodiment of the present disclosure.

Block 64 of FIG. 3 relates to FIG. 4. The anchors 46 may be used to restrict longitudinal 54 and/or radial 56 movement of the mechanical service tool 12 with respect to the casing 40. The anchors 46 may include friction pads 66 that may extend radially 56 from the mechanical service tool 12 towards an interior surface 70 of the casing 40. The friction pads 66 may apply a force 68 against the interior surface 70. In one embodiment, the force 68 may be sufficient to support the weight of the mechanical service tool 12 and prevent the mechanical service tool 12 from sliding in the longitudinal 54 direction within the casing 40. In another embodiment, the cable 18 may additionally support a portion or all of the weight of the mechanical service tool 12. Additionally or otherwise, the anchors 46 may centralize the mechanical service tool 12 within the casing 40 by ensuring that an axial centerline 72 of the mechanical service tool 12 and an axial centerline 74 of the casing 40 are concentric.

Figure 5:
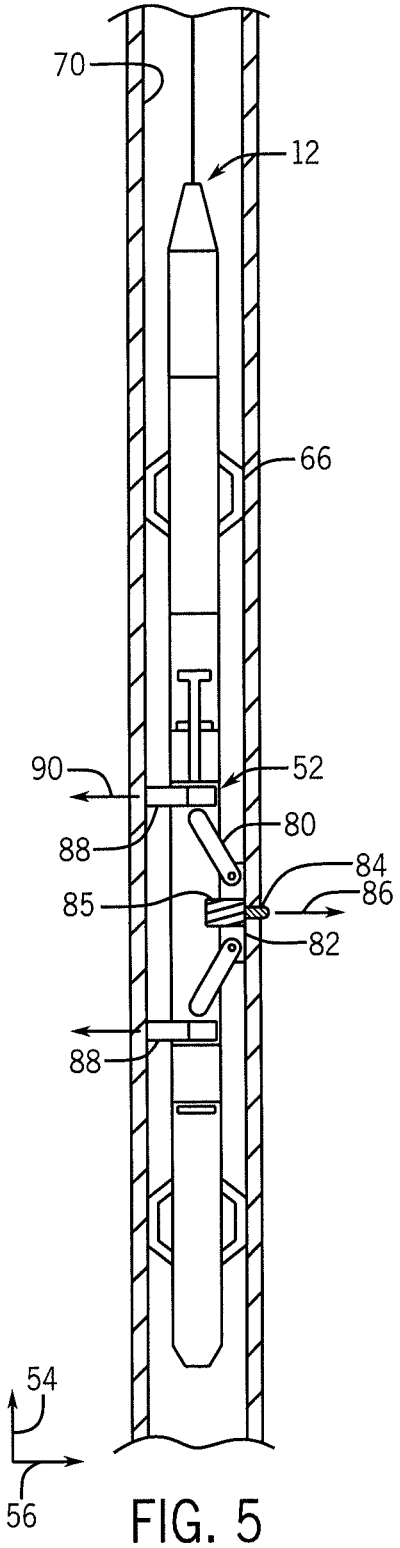
FIG. 5 is a perspective view of the mechanical service tool of FIG. 2, which illustrates a cutter mechanism coupled to the mechanical service tool, in accordance with an embodiment of the present disclosure.

Block 78 of FIG. 3 relates to FIG. 5. The cutter mechanism 52 may include linkages 80 which allow a cutting head 82 housing a drilling bit 84 to extend towards the interior surface 70 of the casing 40. As such, the drilling bit 84 may extend perpendicular to the axial centerline 74 of the casing, or at an angle deviating from the axial centerline 74. The drilling bit 84 may rotate through driving motor 85 (e.g., hydraulic motor, electric motor) to facilitate drilling (e.g., penetrating a material). The linkages 80 may couple to actuators (not shown), which may apply a force 86 to the drilling bit 84, and hence the interior surface 70 of the casing 40. As such, the drilling bit 84 may drill (e.g., penetrate) into the casing 40. The drilling bit 84 may be substituted for an additional machining tool, such as an end mill, grinding wheel, or the like. Although only one drilling bit 84 is shown in the illustrated embodiment, the cutting head 82 may house 1, 2, 3, 4, or more drilling bits 84.

In one embodiment, reaction pads 88 (e.g., rollers) may radially extend towards the interior surface 70 of the casing 40 in addition to, or in lieu of, the friction pads 66 of the anchors 46. As discussed in more detail herein, the reaction pads 88 may include rollers which allow the cutter mechanism 52 to rotate about the axial centerline 72 of the mechanical service tool 12. The reaction pads 88 may additionally stabilize and/or or provide rigidity to the mechanical service tool 12 by providing a counter force 90 to the force 86 which may be exerted onto the mechanical service tool 12 by the drilling bit 84. The counter force 90 may prevent axial deflections (e.g., bending in the radial 56 direction) of the mechanical service tool 12 while performing the machining operations on the casing 40.

Block 90 of FIG. 3 relates to FIGS. 6-10. In one embodiment, the cutter mechanism 52 may move longitudinally 54 along the tool body 44 of the mechanical service tool 12. In one embodiment, the anchors 66 may keep the mechanical service tool 12 stationary with respect to the casing 40 while the cutter mechanism 52 moves along the tool body 44. The cutter mechanism 52 may hence move the drilling bit 84 in the longitudinal 54 direction while the drilling bit 84 may drill into the casing 40. For example, the cutting tool 12 may house a linear actuator 92 (e.g., a hydraulic cylinder) that may include a piston rod 94. The piston rod 94 may couple to the cutter mechanism 52. As such, the linear actuator 92 may apply a force 96 to the piston rod 94 that may move the cutter mechanism 52 and hence the drilling bit 84 longitudinally 54 along the axial centerline 72 of the mechanical service tool 12. As set forth above, the reaction pads 88 may stabilize the mechanical service tool 12 and the cutter mechanism 52 while still allowing the cutter mechanism 52 to move in the longitudinal 54 direction with respect to the casing 40. In another embodiment, the entire mechanical service tool 12 may be moved longitudinally 54 within the casing 40 via movement of the cable 18. As such, the drilling bit 84 may create elongated axial holes 98 within the casing 40. In another embodiment, the drilling bit 84 may only partially penetrate the casing 40, such that the longitudinal 54 movement of the drilling bit 84 within the casing 40 may create elongated axial slots.

Figure 7:
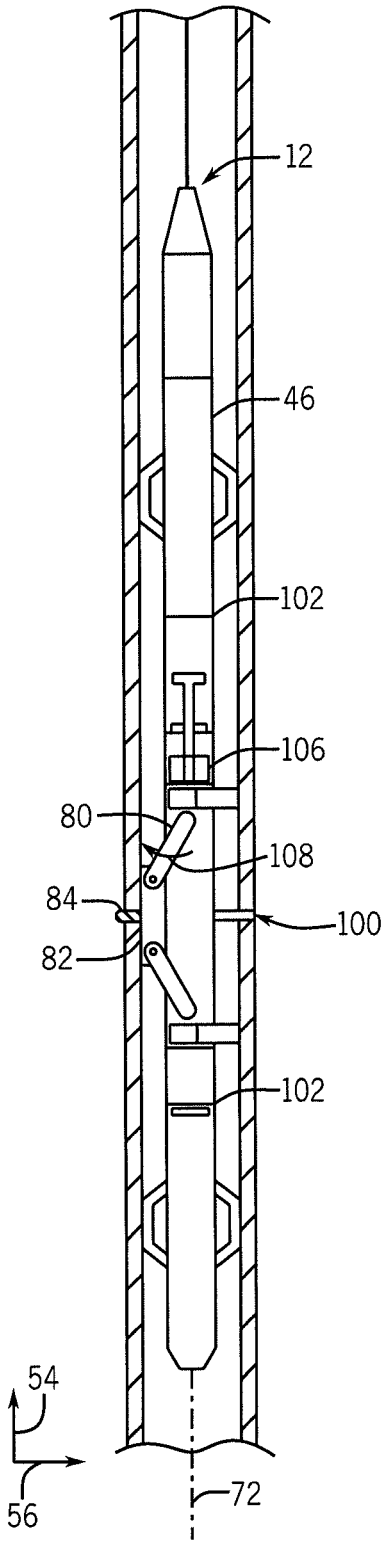
FIG. 7 is a perspective view of the mechanical service tool of FIG. 2, which illustrates the cutter mechanism generating a radial cut within the casing, in accordance with an embodiment of the present disclosure.

In another embodiment, as shown in FIG. 7, the cutter mechanism 52 may be used to create elongated radial holes 100 and/or elongated radial slots within the casing 40. The cutter mechanism 52 may couple to the mechanical service tool 12 via rotatable couplings 102 (e.g., bearing assemblies). In one embodiment, the rotatable couplings 102 may allow the cutter mechanism 52 to rotate about the axial centerline 72 of the mechanical service tool 12 while the remaining portions of the mechanical service tool 12 (e.g., tool body 44, anchors 46) remain stationary with respect to the casing 40. The reaction pads 88 may stabilize the mechanical service tool 12 while still allowing the cutter mechanism 52 to rotate. The cutter mechanism 52 may be rotated via a swivel mechanism 106 (e.g., hydraulic motor, electric motor) which may couple to the mechanical service tool 12 (e.g., the anchors 46). The swivel mechanism 106 may apply a torque 108 to the cutter mechanism 52 which may rotate the cutting head 82 and hence the drilling bit 84 about the axial centerline 72 of the mechanical service tool 12. In another embodiment, the swivel mechanism 106 may rotate the cutter mechanism 52 at an angle about the axial centerline 72.

Figure 6:
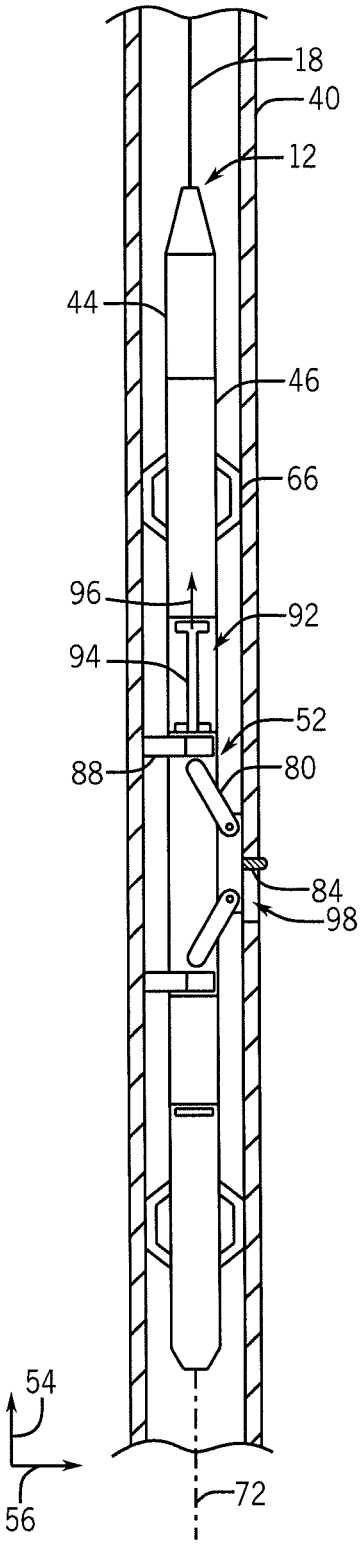
FIG. 6 is a perspective view of the mechanical service tool of FIG. 2, which illustrates the cutter mechanism generating an axial cut within a casing, in accordance with an embodiment of the present disclosure.

In another embodiment, the mechanical service tool 12 may simultaneously perform the processes shown in FIGS. 6 and 7. For example, the drilling bit 84 may move longitudinally 54 along the casing 40 and rotate about the axial centerline 74 of the casing 40. In addition, the linkages 80 may adjust the depth at which the drilling bit 84 may penetrate the casing 40. This may allow the drilling bit 84 to machine cuts of complex geometry into the casing 40.

Figure 8:
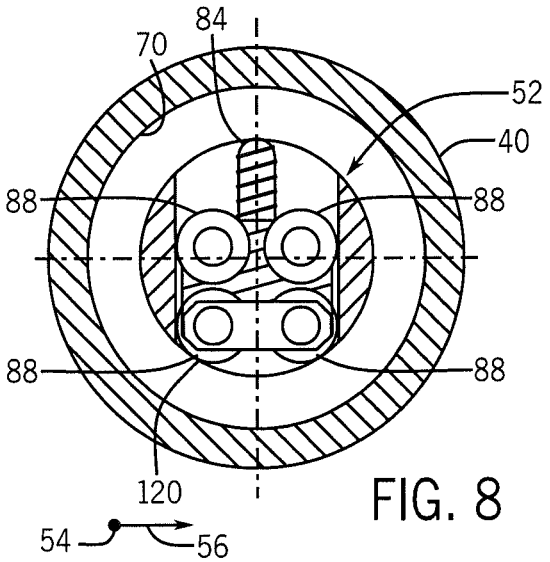
FIG. 8 is a cross-sectional view of the cutter mechanism of FIG. 5, which illustrates the cutter mechanism in a retracted position within the mechanical service tool, in accordance with an embodiment of the present disclosure.
Figure 9:
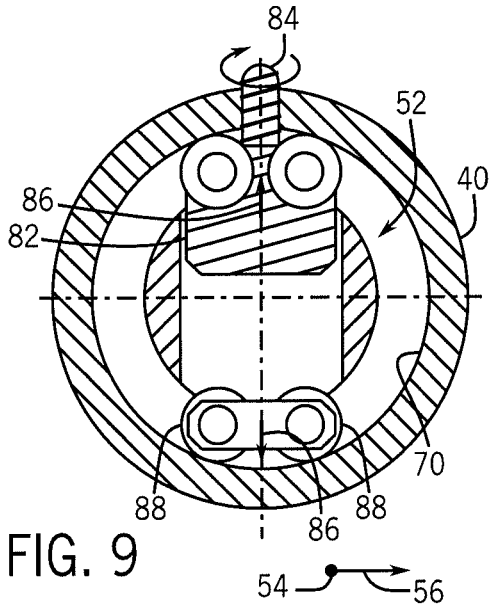
FIG. 9 is a cross-sectional view of the cutter mechanism of FIG. 5, which illustrates the cutter mechanism in an extended position from the mechanical service tool, in accordance with an embodiment of the present disclosure.
Figure 10:
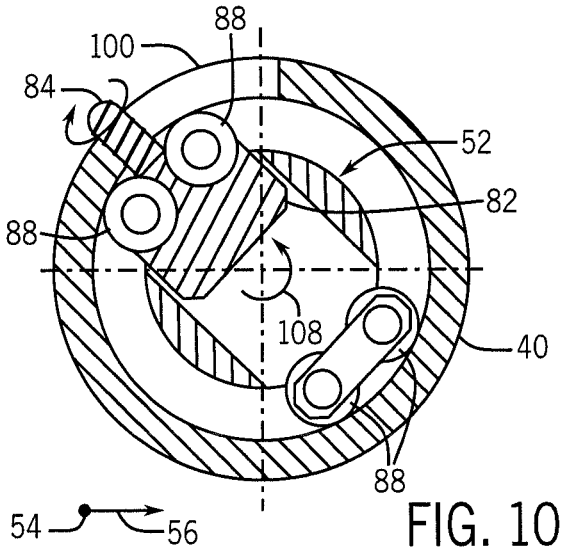
FIG. 10 is a cross-sectional view of the cutter mechanism of FIG. 5, which illustrates the cutter mechanism in generating the radial cut, in accordance with an embodiment of the present disclosure.

FIGS. 8-10 illustrate a cross-sectional view of the casing 40 and the cutter mechanism 52. FIG. 8 shows the cutter mechanism 52 in a retracted position within the mechanical service tool 12 (e.g., as shown in FIG. 4). The reaction pads 88 may include rollers 120 which may move along any direction (e.g., longitudinally 56, circumferentially) along the interior surface 70 of the casing 40. In another embodiment, the cutter mechanism 52 may be completely disposed within the mechanical service tool 12 in the retracted position (e.g., the cutter mechanism 52 does not exceed the smallest radial 56 dimension of the mechanical service tool 12).

FIG. 9 shows the cutter mechanism 52 in an extended position in which the drill bit 84 may apply the force 86 against the casing 40 (e.g., as shown in FIG. 5). The cutter head 82 may extend from the mechanical service tool 12 and towards the interior surface 70 of the casing 40. In one embodiment, the drilling bit 84 may penetrate the casing 40 at a desired depth (e.g., to create a slot or penetrate a hole) by altering the force 86 applied to the drilling bit 84. FIG. 10 shows the cutter mechanism 52 rotating about the axial centerline 72 of the mechanical service tool 12 to create the radial hole 100 and/or elongated slot within the casing 40 (e.g., as shown in FIG. 7). The torque 108 may rotate the cutter mechanism 52 about the longitudinal 54 axis. Additionally or otherwise, the cutter mechanism 52 and drilling bit 84 may move in the longitudinal 54 direction with respect to the casing (e.g., as shown in FIG. 6).

Figure 11:
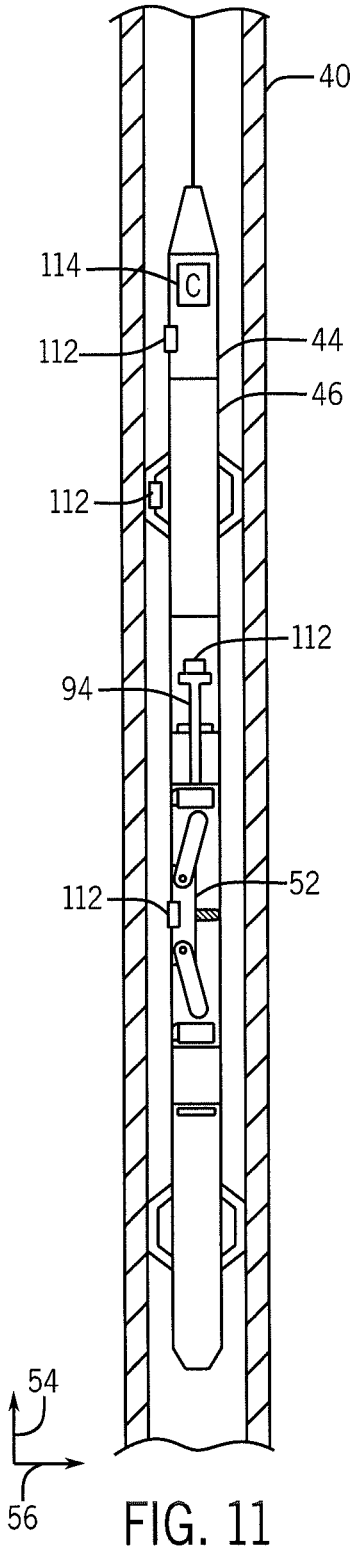
FIG. 11 is a perspective view of the mechanical service tool of FIG. 2, which illustrates sensors disposed about the mechanical service tool, in accordance with an embodiment of the present disclosure.

Block 110 of FIG. 3 relates to FIG. 11. In one embodiment, the mechanical service tool 12 may include one or more sensors 112 coupled to the mechanical service tool 12. As shown in the illustrated embodiment, the one or more sensors 112 may couple to various components of the mechanical service tool 12 such as the tool body 44, anchors 46, cutter head 52, piston rod 94, or any additional component. The one or more sensors 112 may collect pertinent data (e.g., measure displacement of the piston rod 94) about the components of the mechanical service tool 12 and transmit said data to the surface via the telemetry (e.g., via electrical or optical signals pulsed through the geological formation 14 or via mud pulse telemetry). As set forth above, the data processing system 28 may process the data collected by the one or more sensors 112. The one or more sensors 112 may additionally provide data about the position of the mechanical service tool 12 within the wellbore 16.

In one embodiment, the mechanical service tool 12 may include a communication and control system 114 which may receive and process a portion or all of the data received by the one or more sensors 112. The communication and control system 114 may additionally transmit said data to the data processing system 28 via suitable telemetry. In another embodiment, the data processing system 28, communication and controls system 114, or an additional system may use the received data to automate a portion, or all of the machining operations set forth herein.

Figure 13:
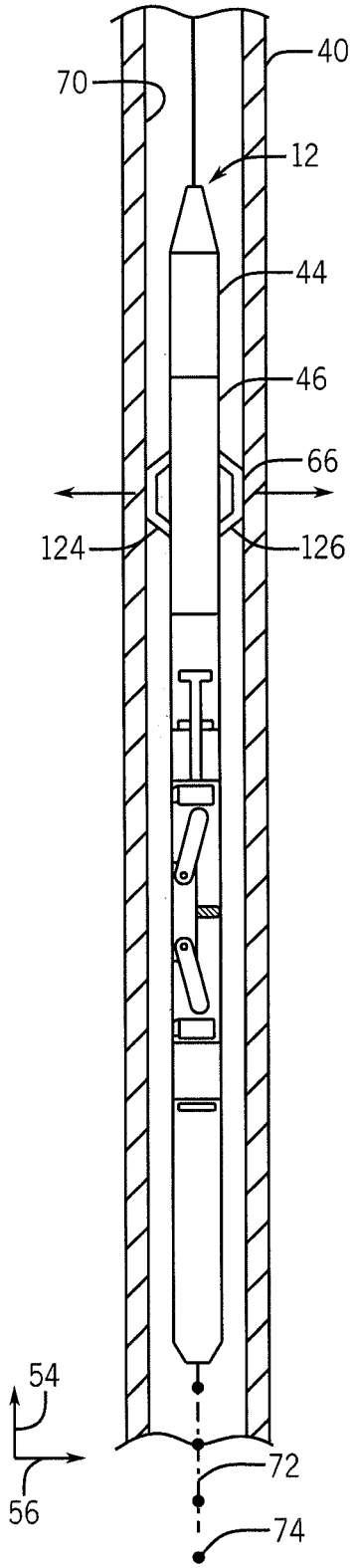
FIG. 13 is a perspective view of the mechanical service tool of FIG. 2, which illustrates the anchors of the mechanical service tool, in accordance with an embodiment of the present disclosure.
Figure 12:
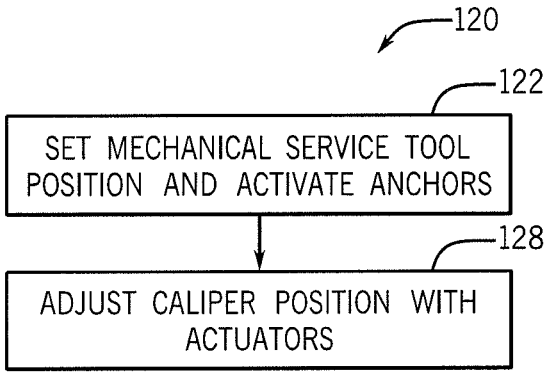
FIG. 12 is a method of operating the anchors of FIG. 4, in accordance with an embodiment of the present disclosure.

The anchors 46 of the mechanical service tool 12 may be rotary-powered, as described by a method 120 shown in FIG. 12. In one embodiment, the anchors 46 may also serve as centralizers. In another embodiment, separate centralizers may be used in combination with, or in lieu of the anchors 46. Block 122 of FIG. 12 relates to FIG. 13. The mechanical service tool 12 may be lowered to a desired depth within the wellbore 16 and the casing 40. The anchors 46 may restrict the longitudinal 54 and/or the radial 56 movement of the mechanical service tool 12 within the casing 40. The friction pads 66 may extend radially 56 from the mechanical service tool 12 towards the interior surface 70 of the casing 40. In one embodiment, the anchors 46 may include a first caliper 124 and a second caliper 126 that may be operated independently. Although only two calipers are shown in the illustrated embodiment, the anchors 46 may include 1, 2, 3, 4, 5, or more calipers.

Figure 14:
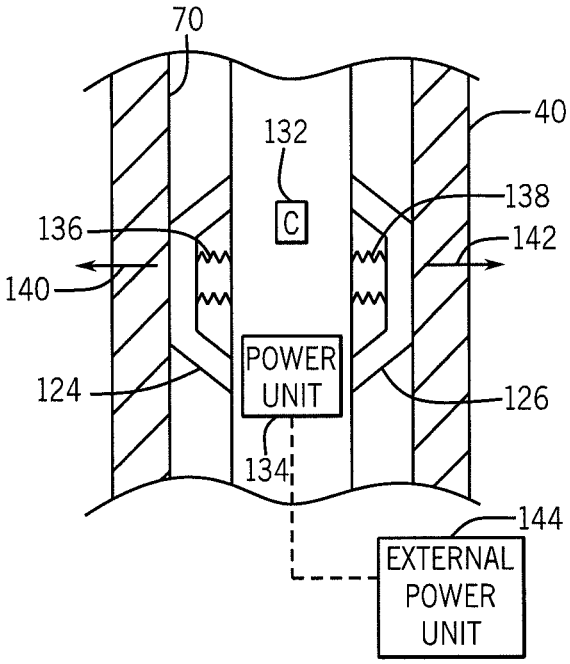
FIG. 14 is a close-up perspective view of the anchors of FIG. 13, in accordance with an embodiment of the present disclosure.

Block 128 of FIG. 12 relates to FIG. 14. A controller 132 may couple to the mechanical service tool 12. The controller 132 may be operatively coupled to the data processing system 28 and may operate a power unit 134 (e.g., one or more electric motors). The first caliper 124 may couple to a first actuator 136 (e.g., a first threaded rod) and the second caliper 126 may couple to a second actuator 138 (e.g., a second threaded rod). In another embodiment, the first caliper 124 and second caliper 126 may couple to the same actuator. The power unit 134 may actuate the first actuator 136 and/or the second actuator 138, such that the first actuator 136 may apply a first force 140 to first caliper 124 and the second actuator 138 may apply a second force 142 to the second caliper 126. For example, the electric motor may be used to rotate the first threaded rod and/or the second threaded rod to apply the first force 140 and the second force 142 respectively.

The first caliper 124 and the second caliper 126 may be used to centralize the mechanical service tool 12 within the casing 40 (e.g., coincide the central axis 72 of the mechanical service tool 12 with the central axis 74 of the casing 40). As such, the first caliper 124 and the second caliper 126 may apply an equal force (e.g., force 140 and force 142) against the inner surface 70 of the casing 40. In another embodiment, the first caliper 124 and the second caliper 126 may offset the axial centerline 72 of the mechanical service tool 12 and the axial centerline 74 of the casing 40. For example, the first force 140 may be smaller than the second force 142, such that the mechanical service tool 12 may move radially, perpendicular to the interior surface 70 of the casing 40. In another embodiment, the first actuator 136 and second actuator 138 may tilt the mechanical service tool 12 at an angle from the longitudinal 54 axis within the casing 40. The anchors 46 may be positioned above or below the cutter mechanism 52. In another embodiment, the anchors 46 may be positioned both above and below the cutter mechanism 52, or at any other position on the tool body 44.

In another embodiment, the power unit 134 may include a hydraulic system (e.g., hydraulic pump). In the same embodiment, the first actuator 136 and the second actuator 138 may include a first hydraulic cylinder and a second hydraulic cylinder respectively. The hydraulic pump may alter a pressure of hydraulic fluid sent to each the first actuator 136 and the second actuator 138 respectively and hence alter a magnitude of the first force 140 and the second force 142 respectively. In another embodiment, the power unit 134 may be replaced, or used in combination with, an external power unit 144 (e.g., an external hydraulic pump) which may be located at the surface of the wellbore 14. The external hydraulic pump may supply the hydraulic fluid required to operate the first actuator 136 and the second actuator 138.

Figure 15:
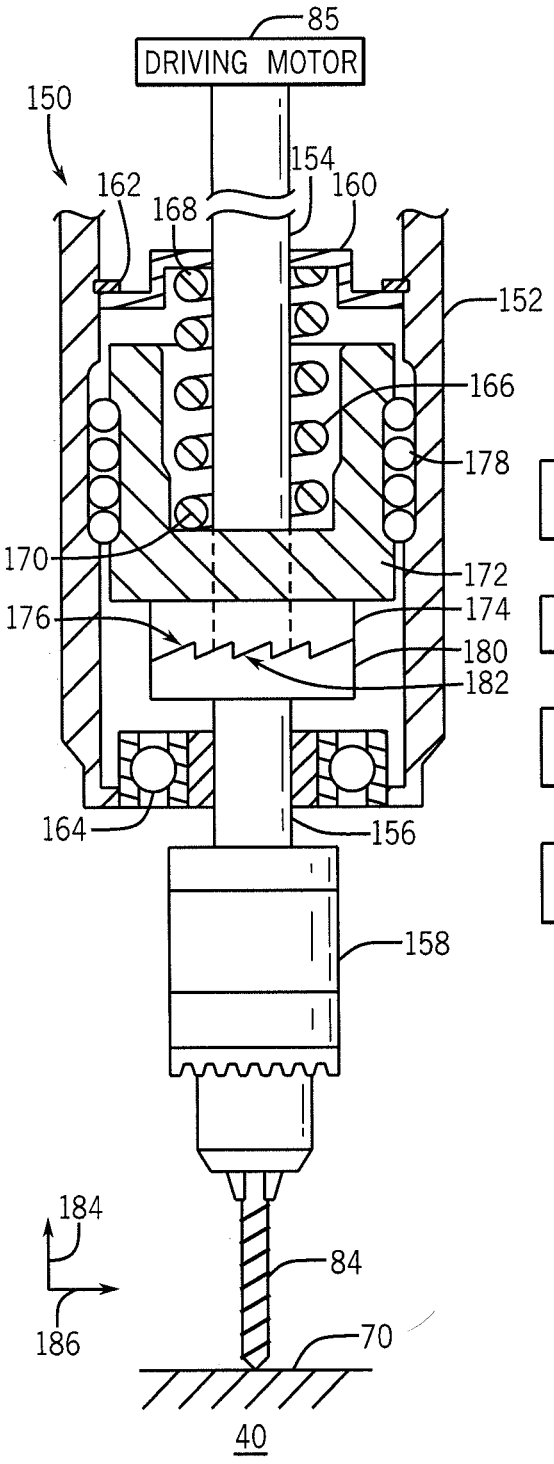
FIG. 15 is a perspective view of an impact system that may couple to the mechanical service tool of FIG. 2, in accordance with an embodiment of the present disclosure.

The mechanical service tool 12 may use an impact system 150, an example of which is shown in FIG. 15. The impact system 150 may couple between the drilling bit 84 and the driving motor 85 of the mechanical service tool 12. The impact system 150 may generate and impart an additional linear impact force and an additional rotational torque to the drilling bit 84. With the foregoing in mind, it may be useful to first describe one embodiment of the impact system 150. The impact system 150 may include a housing 152 through which an upper shaft 154 and a lower shaft 156 may extend. The upper shaft 154 may couple to the driving motor 85 and the lower shaft 156 may couple to a chuck 158 which houses the drilling bit 84. A rotating cap plate 160 may couple to the upper shaft 154. The rotating cap plate 160 of upper shaft 154 may be guided by upper bearings 162 disposed within the housing 152 and the lower shaft 156 may be guided by lower bearings 164 disposed within the housing 152.

A spring 166 may be disposed about the upper shaft 154 such that the upper shaft 154 may rotate within a central portion of the spring 166. The spring 166 may include an upper end portion 168 that may couple to the rotating cap plate 160 and a lower end portion 170 that may couple to an impact weight 172. The impact weight 172 may couple to an upper hammer 174 that includes angled upper teeth 176. Both the impact weight 172 and the upper hammer 174 may rotate independently from the upper shaft 154. The impact weight 172 may be guided by bearings 178 which may be disposed circumferentially between the impact weight 172 and the housing 152. The lower shaft 156 may couple to a lower hammer 180 that includes angled lower teeth 182. To facilitate further discussion, the impact system 150 and its components may be described with reference to an axial direction 184 (e.g., the radial 56 direction with respect to the casing 40 of FIG. 2) and a lateral direction 186 (e.g., the longitudinal 54 direction with respect to the casing 40 of FIG. 2).

Figure 16:
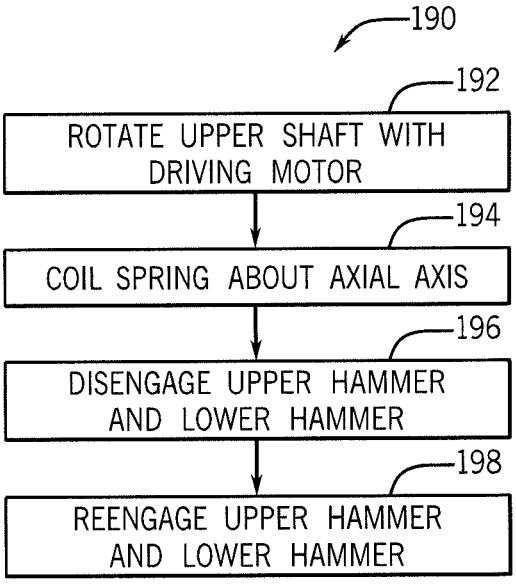
FIG. 16 is a method of operating the impact system of FIG. 15, in accordance with an embodiment of the present disclosure.
Figure 17:
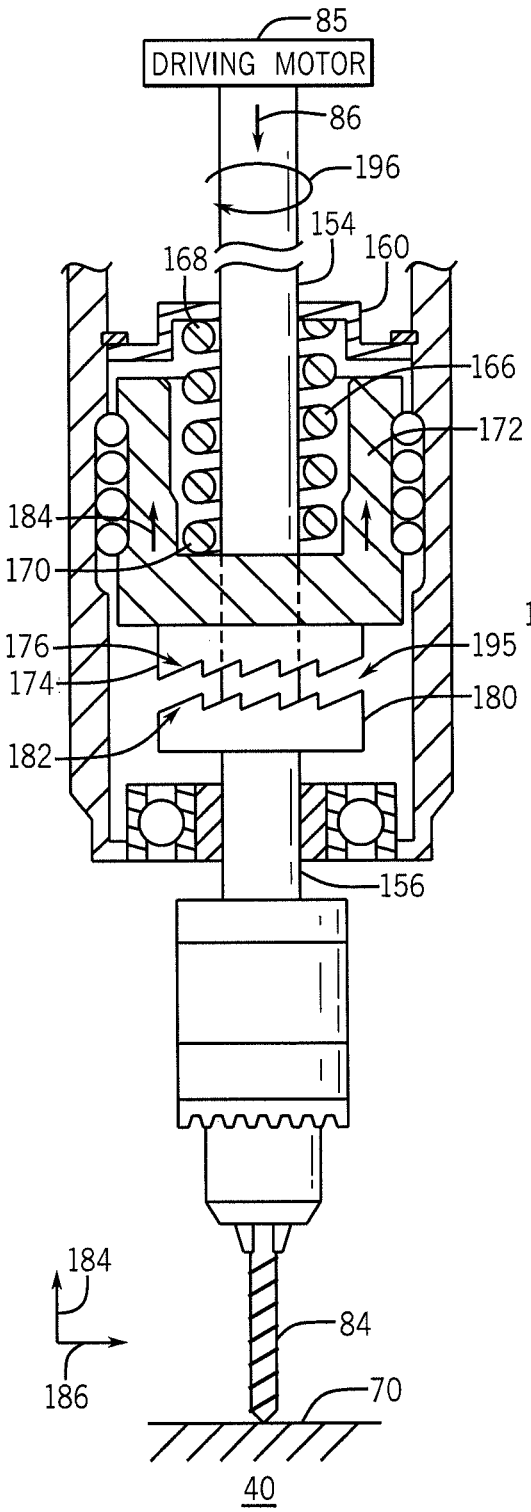
FIG. 17 is a perspective view of the impact system of FIG. 15, showing an impact weight moving to an initial position, in accordance with an embodiment of the present disclosure.

Turning now to FIG. 16, showing an embodiment of a method 190 of operation of the impact system 150. Blocks 192 and 194 relate to FIG. 17. The driving motor 85 may apply a driving torque 196 to the upper shaft 154. The cutter head 52 may apply the linear force 86 (as shown in FIG. 5) to the impact system 150. In the impact system 150, friction between the drilling bit 84 and the inner surface 70 of the casing 40 may temporarily cause the lower shaft 156 to remain stationary. In this embodiment, the upper teeth 176 of the upper hammer 174 may be held stationary by the lower teeth 182 of the lower hammer 180. As such, the impact weight 172 may be restricted from rotation.

The upper end portion 168 of the spring 166 coupled to the cap plate 160 may rotate while the lower end portion 170 of the spring coupled to the impact weight 172 may remain stationary. As such, the rotating cap plate 160 may wind (e.g., coil helically) the spring 166. The winding of the spring 166 may store potential energy in the spring 166. The spring 166 may decrease in length while being coiled about the upper shaft 154 and may move the impact weight 172 and the upper hammer 174 upwards in the axial 184 direction. As the spring 166 contracts, a gap 195 may form between the upper teeth 176 and the lower teeth 182 of the upper hammer 174 and lower hammer 180 respectively.

Figure 18:
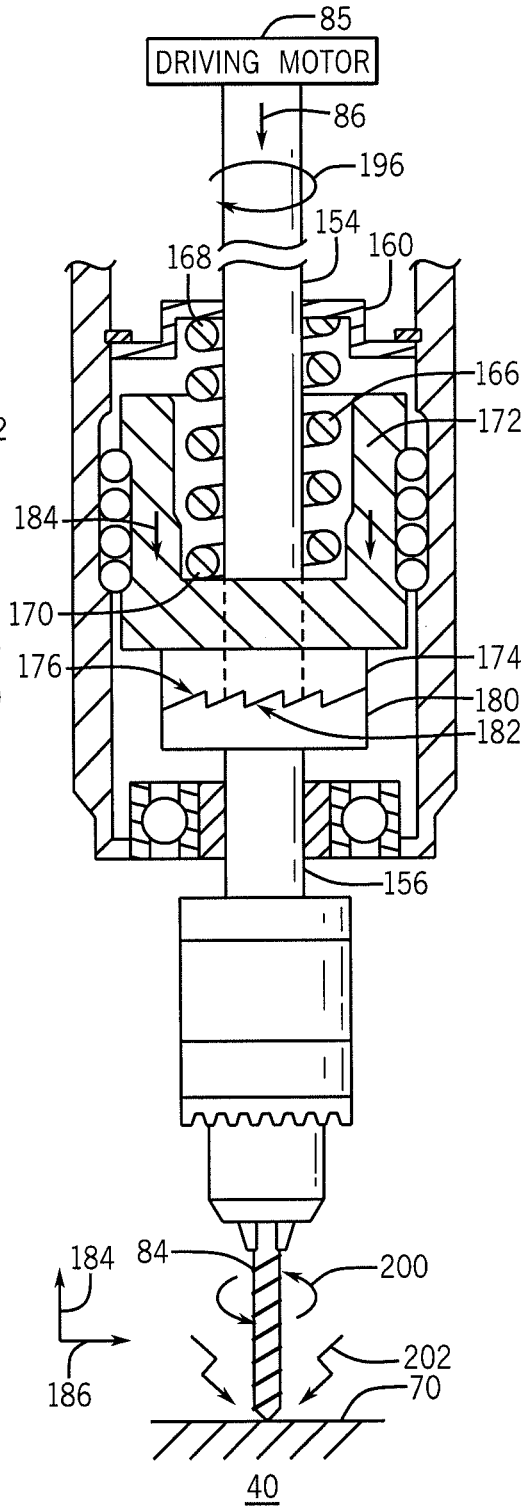
FIG. 18 is a perspective view of the impact system of FIG. 15, showing the impact weight moving to a resting position and generating an impact force, in accordance with an embodiment of the present disclosure.

Blocks 196 and 198 of FIG. 16 relate to FIG. 18. Once the gap 195 surpasses a predetermined distance, the upper hammer 174 and lower hammer 180 may rotate such that the upper teeth 176 and lower teeth 182 move to the next position (e.g., engage with a subsequent tooth). As such, the impact weight 172 and the upper hammer 174 may simultaneously descend axially 195 while rotating about the upper shaft 154 as the spring 166 returns to an uncoiled state (e.g., the spring rotates to release the stored potential energy). The stored potential energy of the spring 166 may be transferred as rotational energy (e.g., inertia) to the impact weight 172 and the upper hammer 174. When the upper teeth 176 and lower teeth 182 reengage, the inertial energy of the rotating impact weight 172 may be transferred to the stationary lower hammer 180 in a small time interval. This may temporarily impart an additional rotational torque 200 to the lower shaft 156 that may be larger than the driving torque 196 originally provided by the driving motor 85. Furthermore, the impact weight 172 may generate an additional linear force 202 when the upper hammer 174 engages with the lower hammer 180 and the axial motion of the impact weight 172 is abruptly halted.

As such, the impact system 150 may generate impulses of rotational torque 200 and linear force 202 by storing energy of the driving motor 85 of a specified time frame (e.g., the rate at which the spring 166 coils and contracts). In some embodiments, the rotational torque 200 and the linear force 202 generated by the impact system may be larger than the driving torque 196 generated by the driving motor 85 and/or the force 86 generated by the linkages 80 of the cutter head 82. FIGS. 15-18 illustrate one embodiment of the impact system 150 and method 190 of operation. However, the first shaft 154 and second shaft 156 may be replaced by a single shaft (e.g., a central shaft). As such, the drilling bit 84 may rotate continuously while the upper hammer 174 and lower hammer 180 coil the spring 166 and store potential energy within the impact system 150.

Figure 19:
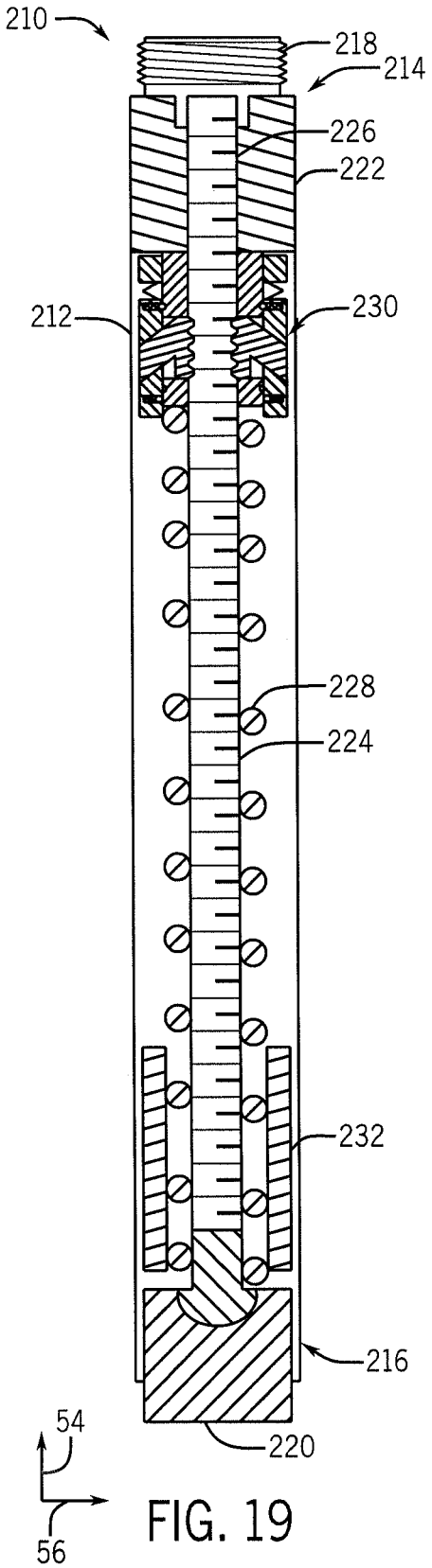
FIG. 19 is a perspective view of a jar tool that may couple to the mechanical service tool of FIG. 2, in accordance with an embodiment of the present disclosure.

FIG. 19 illustrates a jar tool 210 that may couple to the tool body 44 of the mechanical service tool 12. The jar tool 210 may loosen the mechanical service tool 12 from a constriction within the wellbore 16. For example, in one embodiment, the geological formation 14 may shift and hence restrict a diameter (e.g., form the constriction) of the wellbore 16. In this embodiment, the wellbore 16 may pin (e.g., restrict longitudinal 54 movement) the mechanical service tool 12 within the casing 40 and/or the wellbore 16. The jar tool 210 may loosen the mechanical service tool 12 from the wellbore 16 by providing a longitudinal 54 force to the mechanical service tool 12.

The jar tool 210 may include a jar body 212 that includes an upper end portion 214 and a lower end portion 216. In one embodiment, the upper end portion 214 may include threads 218 which may couple the jar tool 210 to the mechanical service tool 12. In another embodiment, the jar tool 210 may include a downhole tool 220 (e.g., the drilling bit 84) coupled to the lower end portion 216 of the jar body 212. As described in greater detail herein, the jar tool 210 may include an anvil 222 (e.g., a spring loaded shuttle) that may deliver an impulse (e.g., a force associated with a sudden change in momentum) to the jar body 212. The anvil 222 may be accelerated (e.g., via the spring 228, gravity) and rapidly halted such to create the impulse. The anvil 222 may be accelerated towards the upper end portion 214 or the lower end portion 216 of the jar tool 210 and may hence generate an impact force in the upward longitudinal 54 direction or the downward longitudinal 54 direction respectively. In another embodiment, the anvil 222 may remain stationary while the hammer assembly moves 230 and may provide the impact force. In yet another embodiment, both the anvil 222 and the hammer assembly 230 may move and generate the impact force. The impact force may be transferred to the mechanical service tool 12 via the threads 218 and may free the mechanical service tool 12 from the construction within the casing 40 and/or the wellbore 16.

In one embodiment, a threaded shaft 224 may protrude through an opening 226 in the anvil 222. A spring 228 may be disposed within the jar body 212 and may include an upper end portion coupled to a hammer assembly 230 and a lower end portion coupled to a retaining sleeve 232. As described in greater detail herein, the hammer assembly 230 and/or anvil 222 may generate the impulse, and hence the longitudinal 54 force.

Figure 20:
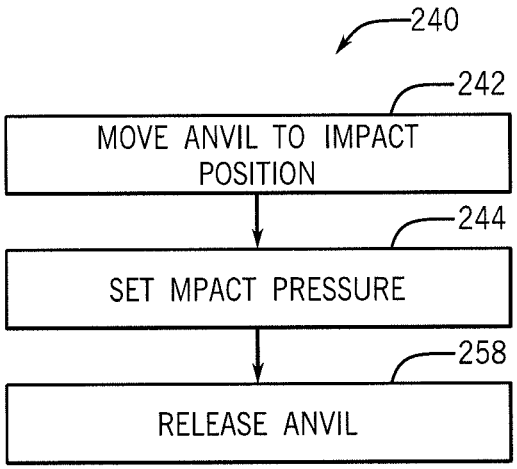
FIG. 20 is a method of operating the jar tool of FIG. 19, in accordance with an embodiment of the present disclosure.

One method 240 that may be used to operate the jar tool 210 appears in FIG. 20. Block 242 of FIG. 20 relates to FIG. 19. The anvil 222 may be moved to a staging position (e.g., the upper end portion 214 of the jar tool 210) such that the anvil 222 may be accelerated and collide with an impact position (e.g., the lower end portion 216 of the jar tool 210) to create the impact force along the longitudinal 54 direction.

Figure 21:
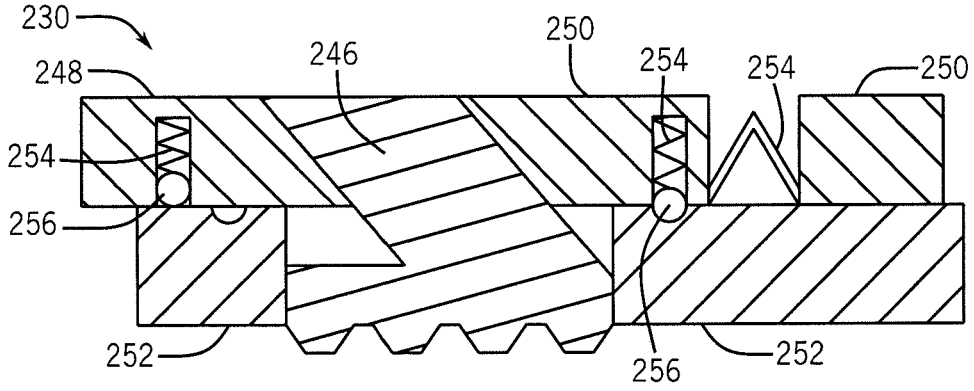
FIG. 21 is a perspective view of a hammer assembly of the jar tool of FIG. 19, illustrating the hammer assembly in an engaged position, in accordance with an embodiment of the present disclosure.

Block 244 of FIG. 20 relates to FIG. 21, which shows a close up perspective view of the hammer assembly 230 of FIG. 19. The anvil 222 may be held in the staging position by the hammer assembly 230. The hammer assembly 230 may include a thread retainer 246 which may couple to the threaded shaft 224 and move the anvil 222 within the jar body 212. In one embodiment, a latching ring 248 and a reset ring 250 may couple or decouple the anvil from the threaded shaft 224. Additionally or otherwise, a hammer 252 may move to the staging position. One or more springs 254 may be used with a position lock 256 to restrict the anvil 222 and/or the hammer 252 in the staging position.

Figure 22:
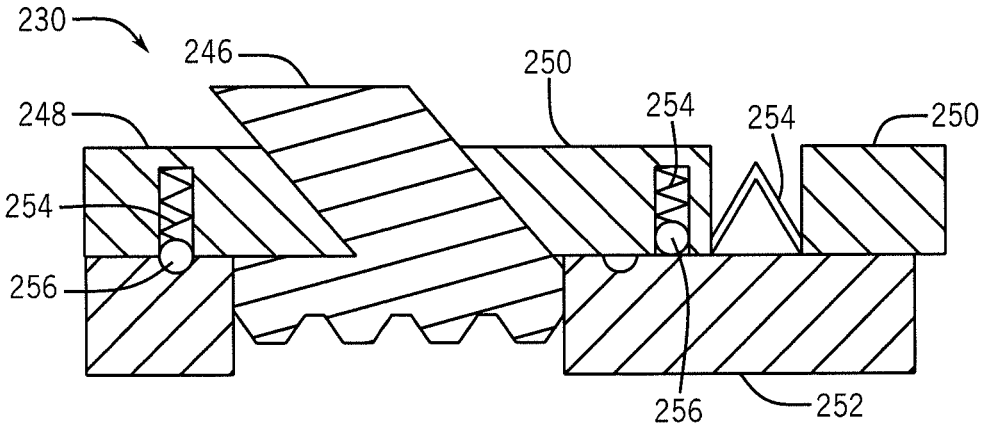
FIG. 22 is a perspective view of the hammer assembly FIG. 21, illustrating the hammer assembly in a released position, in accordance with an embodiment of the present disclosure.

Block 258 of FIG. 20 relates to FIG. 22, which shows the hammer assembly 230 in a released position. In one embodiment, the hammer 252 may shift the thread retained 246 which may decouple the anvil 222 and/or the hammer 252 from the threaded shaft 224. In another embodiment, the spring 228 may accelerate the anvil 222 and or the hammer assembly 230 to the impact positon (e.g., the lower end portion 216 of the jar body 212) which may generate the impact force.

Figure 23:
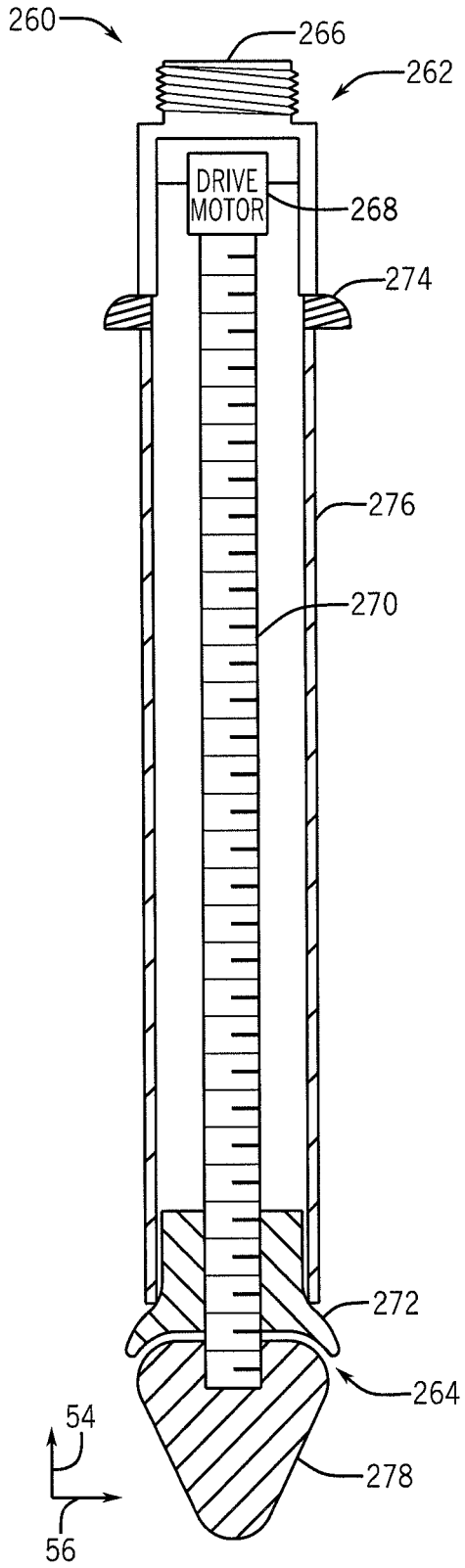
FIG. 23 is a perspective view of a patching tool that may couple to the mechanical service tool of FIG. 2, in accordance with an embodiment of the present disclosure.

As shown in FIG. 23, a patching tool 260 may couple to the mechanical service tool 12 or the cable 18. In one embodiment, the patching tool 260 may patch a hole (e.g., close a void) within the casing 40 (e.g., such as the axial holes 98 or radial holes 100 creates by the drilling bit 84 shown in FIGS. 6 and 7 respectively). The patching tool 260 may include an upper end portion 262 and a lower end portion 264. In one embodiment, the patching tool 260 may include a threaded adapter 266 near the upper end portion 262 that may couple the patching tool 260 to the mechanical service tool 12. In another embodiment, the patching tool 260 may couple directly to the cable 18.

Drive motor 268 (e.g., hydraulic motor, electric motor) may be disposed within the threaded adapter 266 of the patching tool 260. In another embodiment, the drive motor 168 may couple to the mechanical service tool 12, or any other portion of the patching tool 260. The drive motor 268 may couple to a threaded shaft 270 that extends from the upper end portion 262 to the lower end portion 264 of the patching tool 260. A shuttle 272 configured to move along the threaded shaft 270 may couple to the threaded shaft 270 near the lower end portion 264 of the patching tool 260.

In one embodiment, a clearance wedge 274 may couple to the threaded adapter 266. The clearance wedge 274 may guide the patching tool 260 while ascending or descending into the casing 40. In addition, the clearance wedge 274 may prevent damage to a patching sleeve 276. In one embodiment, the patching sleeve 276 may be disposed about the threaded rod 270 and extend from the clearance wedge 274 to the shuttle 272. The clearance wedge 274 and the shuttle 272 may centralize (e.g., coincide a centerline of the patching sleeve 276 with a centerline of the patching tool 260) the patching sleeve 276 with the patching tool 260. A nose cone 278 may couple to the lower end portion 264 of the threaded rod 270.

Figure 24:
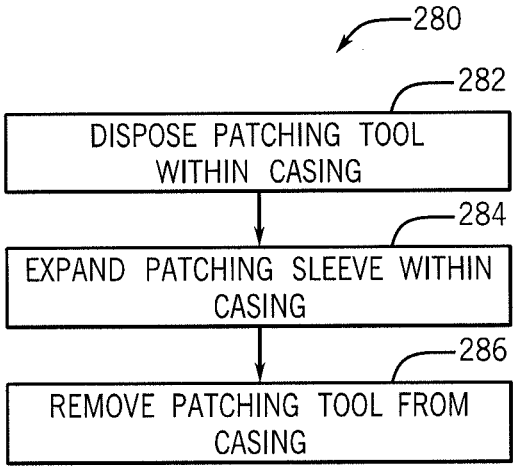
FIG. 24 is a method of operating the patching tool of FIG. 23, in accordance with an embodiment of the present disclosure.
Figure 25:
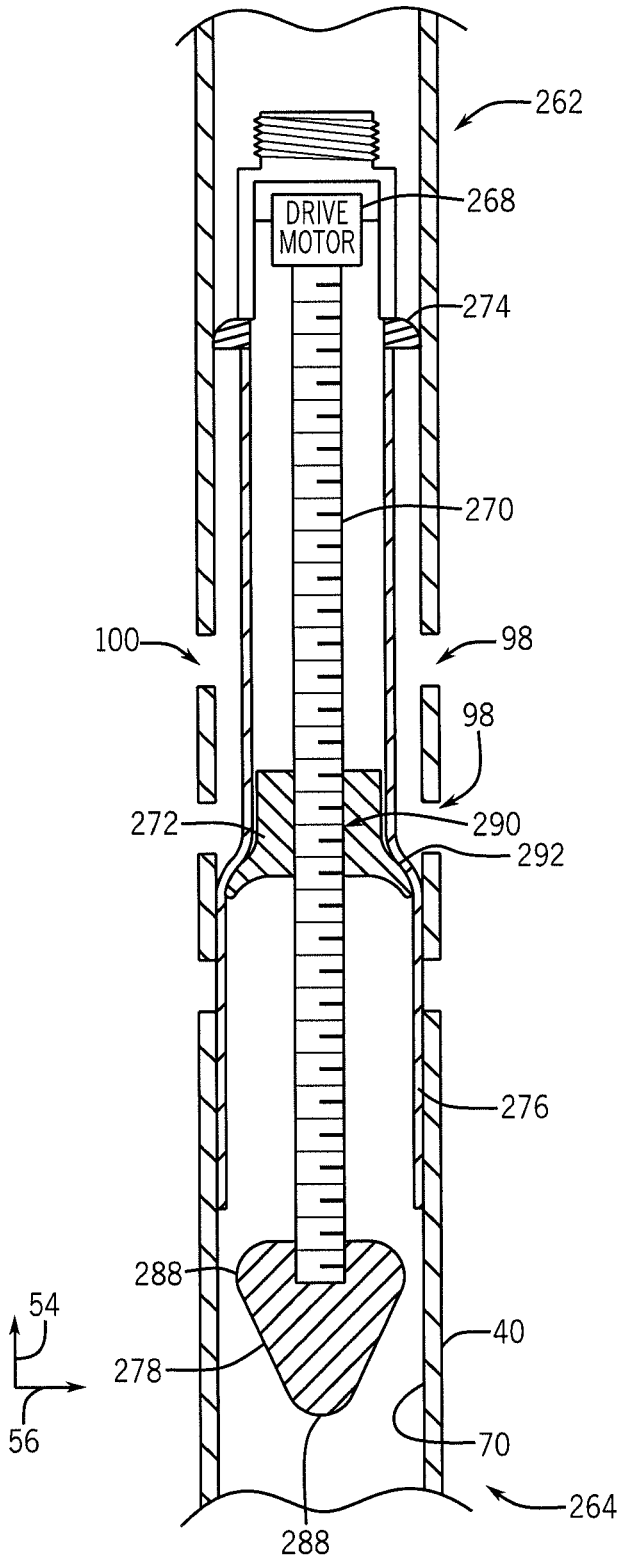
FIG. 25 is a perspective view of the patching tool of FIG. 23, illustrating the patching tool expanding a patching sleeve, in accordance with an embodiment of the present disclosure.

A method 280 of operating the patching tool 260 is shown in FIG. 24. Blocks 282, 284, and 286 of FIG. 24 relate to FIG. 25. As described in block 282, the patching tool 260 may be disposed within the casing 40 of the wellbore 16 such that the patching sleeve 276 is disposed beneath (e.g., radially inward) punctured or weakened areas of the casing 40. For example, the patching tool 260 may be disposed adjacent to the axial holes 98 or radial holes 100 that may have been previously created by the drilling bit 84. In another embodiment, the patching tool 260 may be placed adjacent to portions of the casing 40 that may have been damaged by the geological formation 14 (e.g., due to corrosive fluids, abrasion). The nose cone 278 may include rounded edges 288 that may prevent the patching tool 260 from binding with the inner surface 70 of the casing 40 while the patching tool 260 moves within the casing 40. Additionally or otherwise, the nose cone 278 may protect the patching sleeve 276 from physical contact with the casing 40 while the patching tool 260 moves within the casing 40. In one embodiment, the clearance wedge 274 may centralize the patching tool 260 within the casing 40, such that the patching sleeve 276 does not physically contact the inner surface 70 of the casing 40.

With reference to block 284 of FIG. 24, the driving motor 268 may rotate the threaded shaft 270 disposed within the patching sleeve 276. The shuttle 272 may include threads 290 that couple to the threaded shaft 270. As such, the rotating shaft 270 may longitudinally 54 move the shuttle from the lower end portion 264 to the upper end portion 262 of the patching tool 260 while the patching tool 260 may remain stationary (e.g., does not move longitudinally 54 within the casing 40). The shuttle 290 may include a chamfer 292 configured to circumferentially expand the patching sleeve 276 as the shuttle 290 moves from the lower end portion 264 to the upper end portion 262 of the patching tool 260. In one embodiment, the patching sleeve 276 may be pressed against the interior surface 70 of the casing 40. The patching sleeve 276 may cover the punctured or weakened areas of the casing 40 (e.g., the axial holes 98) such that the interior region 42 of the casing 40 may be isolated from the geological formation 14 in which the casing 40 may be disposed.

With reference to block 286 of FIG. 24, the patching tool 260 may be removed from the casing 40 after the patching sleeve 276 has been circumferentially expanded. In one embodiment, the patching sleeve 276 may remain coupled to the casing 40 through frictional forces between the patching sleeve 276 and the interior surface 70 of the casing 40. In another embodiment, an adhesive (e.g., bonding glue) configured to retain the position of the patching sleeve 276 with the casing 40 may be applied to the interior surface 70 of the casing 40, or an external surface of the patching sleeve 276. The rounded edges 288 of the nose cone 278 may ensure that the patching sleeve 276 is not damaged when the patching tool 260 is removed from the casing 40.

Figure 26:
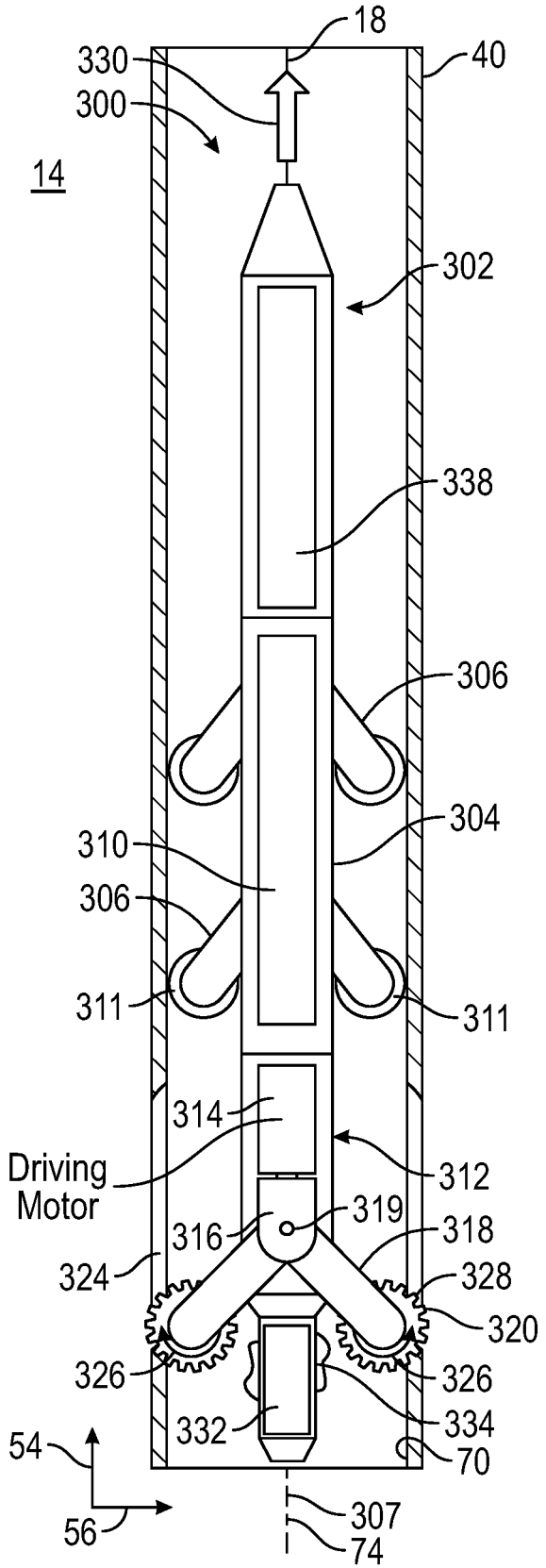
FIG. 26 is a perspective view of a rotary cutter tool that may traverse the wellbore of FIG. 1, in accordance with an embodiment of the present disclosure.

Turning now to FIG. 26, a rotary cutter tool 300 may be used in addition to, or in lieu of, the mechanical service tool 12 of FIG. 1. The rotary cutter tool 300 may couple to a portion of the mechanical service tool 12 (e.g., the tool body 44) and/or couple to the cable 18. The rotary cutter tool 300 may be disposed within the casing 40 and may traverse the casing 40 by raising or lowering the cable 18. In one embodiment, the rotary cutter tool 300 may be disposed directly within the wellbore 16 of the geological formation 14. As described in more detail herein, the rotary cutter tool 300 may perform additional mechanical operations (e.g., milling, grinding, cutting) within the casing 40 and/or against the formation 14 along the wall of the wellbore 16. With the foregoing in mind, it may be useful to first describe one embodiment of the rotary cutter tool 300.

The rotary cutter tool 300 may include a main body 302 that couples to a centralizer section 304 and/or additional subcomponents of the rotary cutter tool 300. The centralizer section 304 may include one or more centralizing arms 306 that may centralize the rotary cutter tool 300 within the casing 40. For example, the centralizer section 300 may ensure that an axial centerline 307 of the mechanical service tool 12 and the axial centerline 74 of the casing 40 are concentric. The centralizer section 304 may include an opening system 310 (e.g., a threaded shaft, a hydraulic cylinder) that may radially extend the centralizing arms 306 from the rotary cutter tool 300. In one embodiment, the centralizing arms 306 may include rollers 311 that allow the main body 302 of the rotary cutter tool 300 to rotate about the central axis 74 of the casing 40. Additionally or otherwise, the centralizing arms 306 may restrict longitudinal 54 movement of the rotary cutter tool 300 within the casing 40 by applying a force to the interior surface 70 of the casing 40.

The rotary cutter tool 300 may include a cutting section 312 that performs the mechanical operations within the casing 40. The cutting section 312 may include a driving motor 314 (e.g., electric motor, hydraulic motor) coupled to a gearbox 316. In one embodiment, cutting arms 318 including rotating cutters 320 (e.g., circular grinding discs) may extend radially from the cutting section 312. As described in greater detail herein, the cutters 320 may rotate perpendicular to the central axis 74 of the casing 40 (e.g., about the radial 56 direction) and may advance in a direction parallel to the central axis 74 of the casing 40 (e.g., in the longitudinal 54 direction). The cutting arms 318 may include internal gears that rotationally couple the cutters 320 to the gearbox 316. Additionally or otherwise, the cutting arms 318 may include a chain drive that couples the cutters 320 to the gearbox 316. As such, the driving motor 314 may generate a torque to rotate the cutters 320.

The cutting arms 318 may radially extend from the cutting section 312 towards the interior surface 70 of the casing 40 via actuators (e.g., a threaded rod, a hydraulic cylinder) that move the cutting arms 318. In one embodiment, the cutting arms 318 may force the cutters 320 radially 56 outward against the interior surface 70 of the casing 40. As such, the cutters 320 may machine (e.g., remove material) from the casing 40. The cutting arms 318 may include a pivot 319 disposed above the cutters 320. As such, there may be a lesser chance of the rotary cutter tool 300 getting stuck within the casing 40 when removing the rotary cutter tool 300 from the casing 40, because the cutting arms 318 may have a natural tendency to close when the rotary cutter tool 300 is moved upwards in the longitudinal 56 direction.

In one embodiment, the cutters 320 may completely penetrate the casing 40 and create an axial hole 324 within the casing 40. Additionally or otherwise, the cutters 320 may only penetrate a portion of the casing 40 such to create axial slots within the casing 40. In one embodiment, the rotary cutter tool 300 may rotate about the central axis 74 of the casing 40 while the cutters 320 partially or completely penetrate the casing 40. As such, the rotatory cutter tool 300 may create radial slots or radial holes in the casing 40. As described in greater detail herein, the rotatory cutter tool 300 may additionally move axially along the central axis 74 of the casing 40 while machining portions of the casing 40. As such, the rotary cutter tool 300 may alter a thickness of a portion of the casing 40, and/or completely sever a portion of the casing 40.

In one embodiment, the cutters 320 may rotate in a direction as indicated by arrows 326, in which an up-hole portion 328 of the cutters 320 rotate towards the central axis 307 of the rotary cutter tool 300. As such, the cutters 320 may generate a linear shear force on the internal surface 70 of the casing 40 when the cutters 320 contact the interior surface 70. This shear force may pull the rotary cutter tool 300 downward in the longitudinal 54 direction. The cable 18 may apply a force 330 that counteracts the linear shear force generated by the cutters 320 and holds the rotary cutter tool 300 stationary within the casing 40 of the wellbore 16. In one embodiment, the force 330 applied by the cable 18 may be decreased such that the cutters 320 may pull the rotary cutter tool 300 downward in the longitudinal 54 direction. Additionally or otherwise, the force 330 applied by the cable 18 may be increased such that the rotary cutter tool 300 is pulled upward in the longitudinal 54 direction. Thus, the longitudinal 54 movement of the rotary cutter tool 30 may be controlled by slacking or loosening the cable 18. In one embodiment, a separate device may control the longitudinal 54 movement of the rotary cutter tool 300, such as a tractor tool.

The rotary cutter tool 300 may include a magnet 332 that collects debris 334 (e.g., metal shavings) that may be generated while the mechanical operations are performed on the casing 40. As such, the magnet 332 may prevent debris 334 from accumulating within the casing 40. In one embodiment, a debris basket (e.g., a container coupled below the magnet 332) may be used in addition to, or in lieu of, the magnet 332. The debris basket may be disposed below the cutters 320 and collect debris 334 falling from the portion of the casing 40 undergoing machining operations.

In one embodiment, the rotary cutter tool 300 may include an electronics section 338 that houses various electronic components that may be used to control the rotary cutter tool 300. For example, the electronics section 338 may include a processor that is communicatively coupled to the driving motor 314 and the data processing system 28. As such, an operator (e.g., human operator, computer system) may control the driving motor 314 of the rotary cutter tool 300 from the surface of the wellbore 16. In one embodiment, the rotary cutter tool 300 may include one or more sensor that are communicatively coupled to the electronics section 338. The one or more sensors may monitor operation conditions (e.g., temperature, rotations per minute) of the rotary cutter tool 300 and transmit this information to the electronics section 338 for processing and further transmittal to the data processing system 28.

Figure 27:
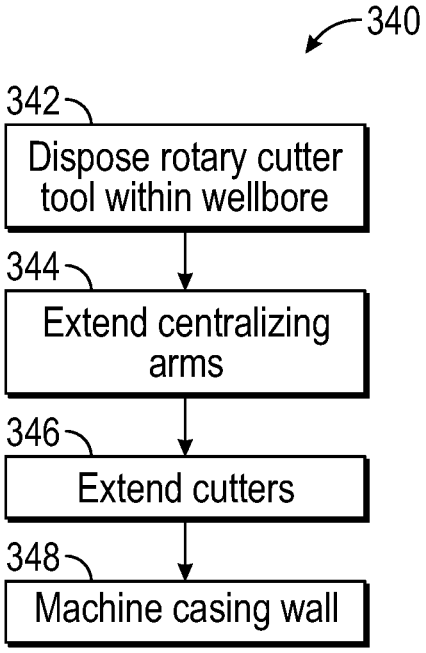
FIG. 27 is a method of operating the rotary cutter tool of FIG. 26, in accordance with an embodiment of the present disclosure.

A method 340 of operating the rotary cutter tool 300 is shown in FIG. 27. Blocks 342, 344, 346, and 348 of FIG. 27 relate to FIG. 28. As described in block 342 of FIG. 27, the rotary cutter tool 300 may be disposed within the casing 40 using the cable 18. The cable 18 may move the rotary cutter tool 300 longitudinally 54 within the casing 40 such that the rotary cutter tool 300 may perform the mechanical operations on a desired portion of the casing 40. As described in block 344 of FIG. 27, the centralizing arms 306 may radially 56 extend from the rotary cutter tool 300 and centralize the rotary cutter tool 300 within the casing 40. The centralizing arms 306 may additionally support the rotary cutter tool 300 while the rotary cutter tool 300 performs the machining operations.

Figure 28:
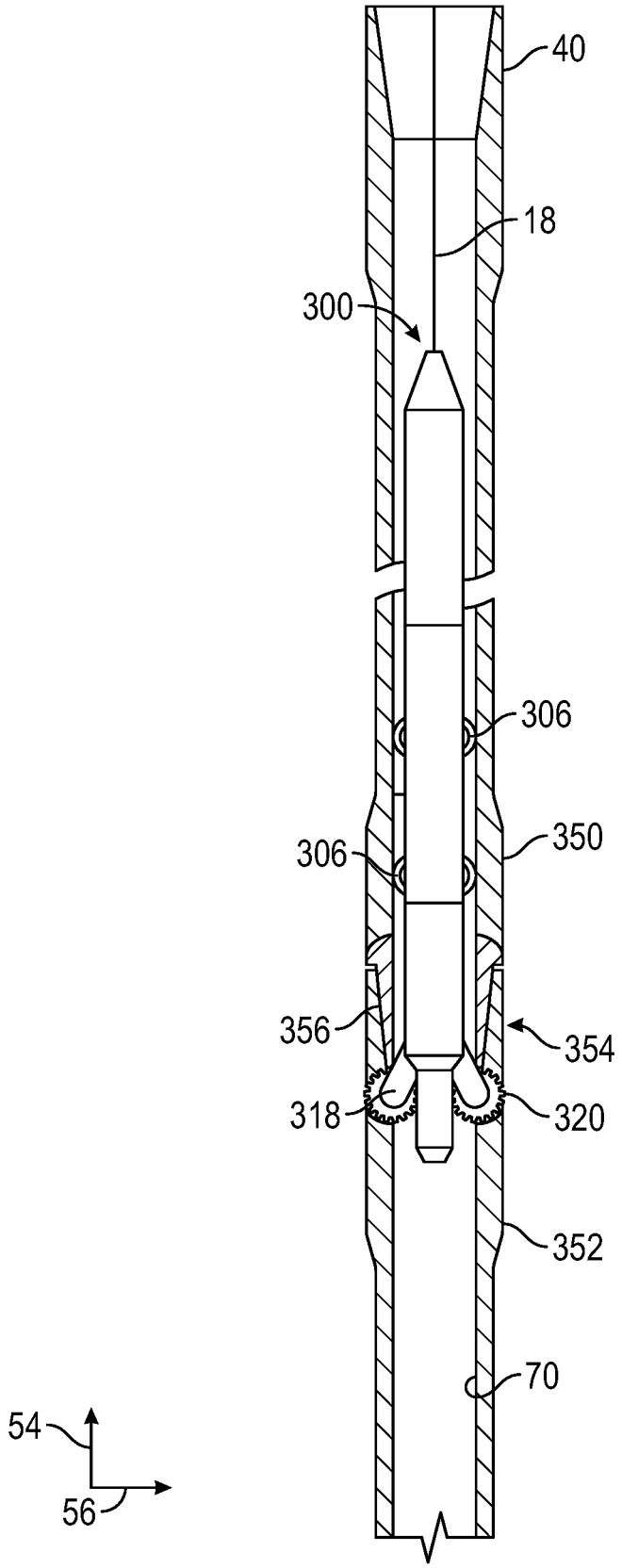
FIG. 28 is a perspective view of the rotary cutter tool of FIG. 26, illustrating the rotary cutter tool making a cut within a portion of the casing, in accordance with an embodiment of the present disclosure.

As described in block 346 of FIG. 27, the cutting arms 318 may radially 56 extend the cutters 320 towards the interior surface of the casing 40. As described in block 348 of FIG. 27, the cutters 320 may machine portions of the casing 40. For example, as shown in FIG. 28, the cutters 320 may sever and/or disconnect a first section 350 of casing 40 from a second section 352 of casing 40 by severing a threaded connection 354 between the first section 350 of casing 40 and the second section 352 of casing 40. For example, the rotary cutter tool 300 may sever the threaded connection 354 by radially 56 penetrating the threaded connection 354 using the cutters 320 and subsequently rotating about the central axis 74 of the casing 40. The rotating cutter tool 300 may additionally move in the longitudinal direction 54 to sever all threads 356 of the threaded connection 354. In another embodiment, the rotary cutter tool 300 may sever a portion of the casing 40 other than the threaded connection 354.

Figure 29:
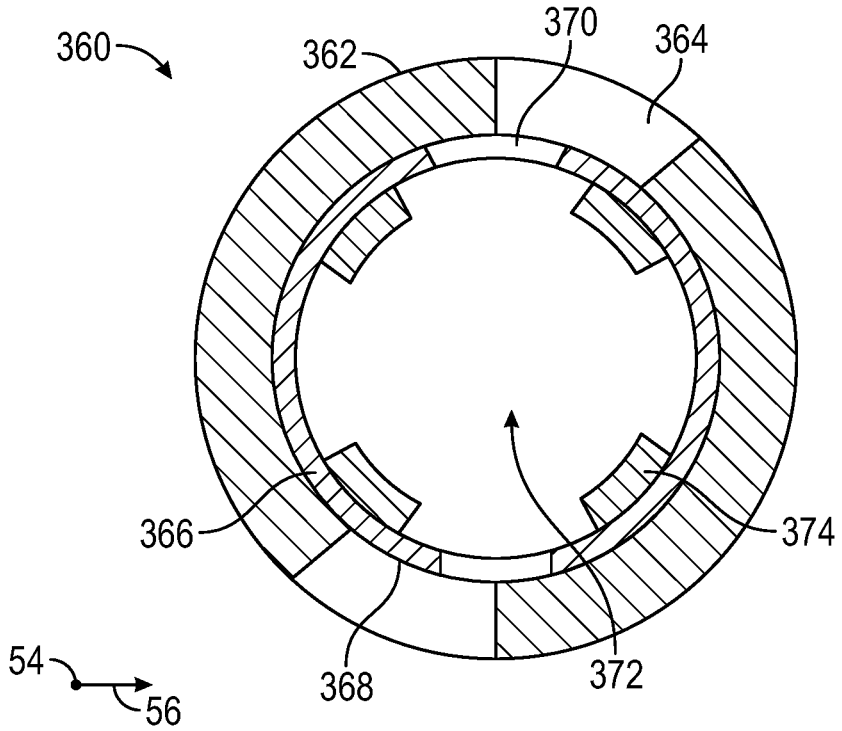
FIG. 29 is a cross-sectional view of a flow control device that may regulate the flow of fluids within the wellbore of FIG. 1, in accordance with an embodiment of the present disclosure.

When a hole has been created in the casing 40, a flow control device may be used to regulate the flow of wellbore fluids or formation fluids into the casing 40. For example, as shown in FIG. 29, a flow control device 360 may be disposed within the casing 40 and used to regulate a flow of wellbore fluids that may enter the casing 40 from the wellbore 16. The flow control device 360 may be an integrated component of the casing 40, coupled to the interior surface 70 of the casing 40, or coupled to the mechanical service tool 12. In one embodiment, the flow control device 360 may be disposed over a hole created in the casing 40 (e.g., the axial holes 98 generated by the cutter tool 12 or the rotary cutter tool 300) in order to regulate the wellbore fluids that may flow through the hole in the casing 40.

In one embodiment, the flow control device 360 may include a stationary component 362 with slots 364 circumferentially disposed about the stationary component 362. In one embodiment, the slots 364 may be aligned with the hole in the casing 40 (e.g., the axial hole 98) and allow wellbore fluids to enter the slots 364 of the stationary component 362. As discussed in greater detail herein, the flow control device 360 may include a floating element 366 disposed radially inward from an interior surface 368 of the stationary component 364. In one embodiment, an exterior surface of the floating element 366 may contact the interior surface 368 of the stationary component 362. The floating element 366 may include additional slots 370 that allow the wellbore fluid to enter the flow control device 360. As such, in one embodiment, when the slots 364, 370 are aligned with the hole in in the casing 40 the wellbore fluids may flow from the geological formation 14 through the hole in the casing 40, the slot 364 of the stationary component 362, the slot 370 of the floating element 368, and into an internal space 372 of the flow control device 360.

In one embodiment, the floating element 366 may rotate within the stationary element 362. A prime mover 374 may move the floating element 366 within the stationary component 362. As such, the prime mover 374 may be used to regulate the flow of wellbore fluid in the flow control device by opening, closing, or choking off the flow of wellbore fluid through the slots 364, 370. For example, when the slots 364, 370 are aligned, the wellbore fluids may flow into the casing uninhibited 40. In one embodiment, when the slots 364 of the stationary component 362 and the slots 370 of the floating element 366 are offset by 90 degrees (e.g., not aligned) no wellbore fluids may flow into the casing 40.

Figure 30:
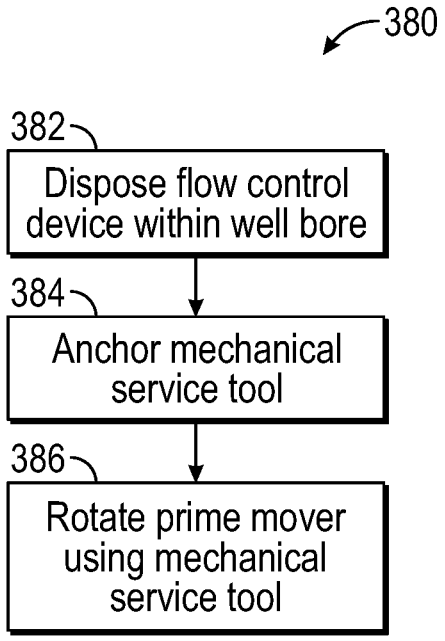
FIG. 30 is a method of operating the flow control device of FIG. 29, in accordance with an embodiment of the present disclosure.
Figure 31:
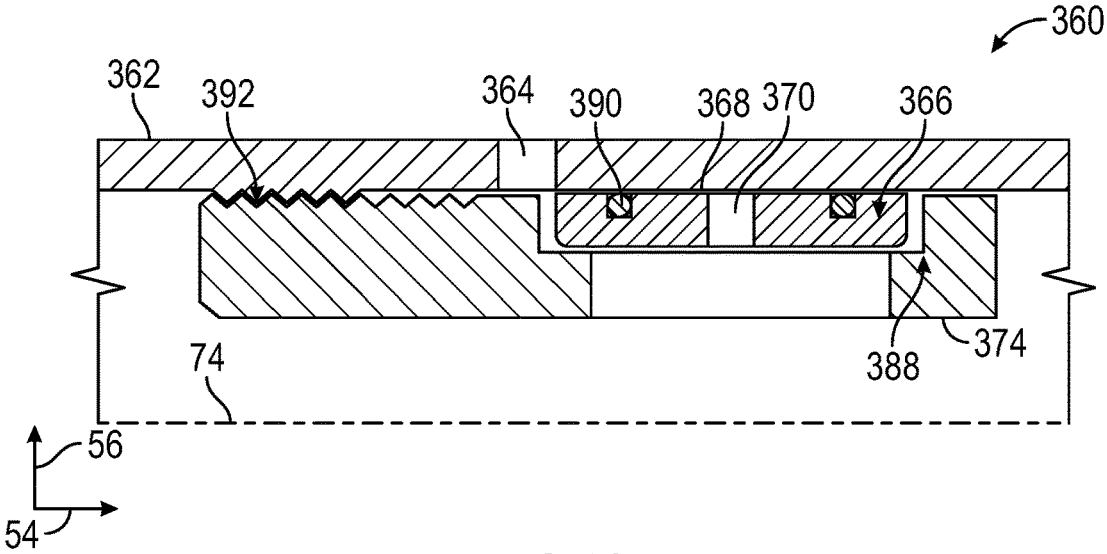
FIG. 31 is a perspective view of the flow control device of FIG. 29, illustrating a floating element and a threaded prime mover disposed within the flow control device, in accordance with an embodiment of the present disclosure.
Figure 32:
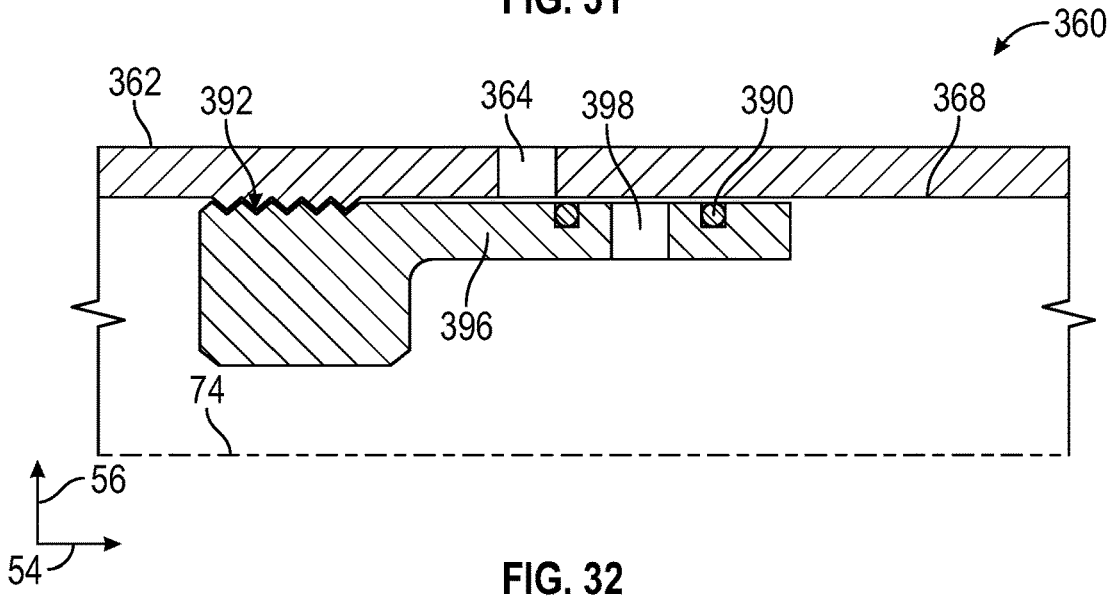
FIG. 32 is a perspective view of the flow control device of FIG. 29, illustrating a threaded floating element disposed within the flow control device, in accordance with an embodiment of the present disclosure.
Figure 33:
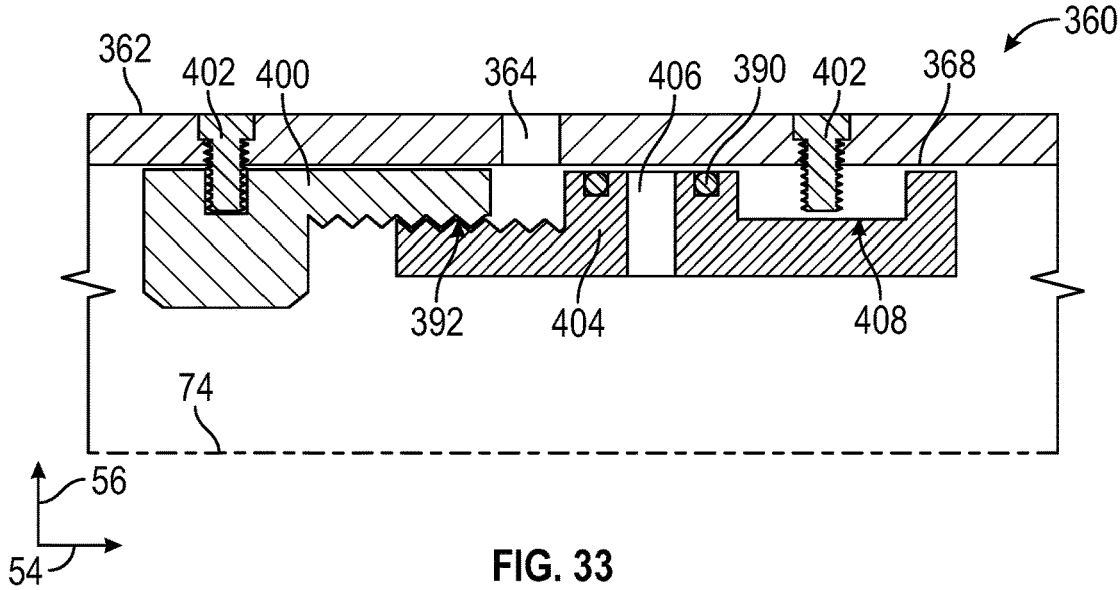
FIG. 33 is a perspective view of the flow control device of FIG. 29, illustrating a threaded and notched floating element disposed within the flow control device, in accordance with an embodiment of the present disclosure.

A method 380 for operating the flow control device 360 is shown in FIG. 30. Block 382 of FIG. 30 relates to FIG. 29, in which the flow control device 360 may be disposed within the casing 40 of the wellbore 16 and aligned with the hole in the casing 40. Blocks 384 and 386 of FIG. 30 relate to FIGS. 31-33. As set forth above, in one embodiment, the mechanical service tool 12 may operate the flow control device 360 and therefore regulate the flow of wellbore fluids into the casing 40. For example, the mechanical service tool 12 may be disposed within the wellbore 16 using the cable 18. In order to prevent rotation of the mechanical service tool 12, the mechanical service tool 12 may extend anchors 46 that affix the mechanical service tool 12 to the casing 40. The mechanical service tool 12 may rotate the prime mover 374 via a gearbox or motor unit coupled to the lower end portion 50 of the mechanical service tool 12. As illustrated in FIGS. 31-33, this rotation of the prime mover 374 may regulate the flow of wellbore fluids into the casing 40 by altering the position of the slots 364 within the stationary component 362 and the slots 370 within the floating element 366.

For example, FIG. 31 illustrates one embodiment of the flow control device 360 in which the floating element 366 is housed within a notch 388 of the prime mover 374. The floating element 366 may slide with respect to the stationary component 362 and the prime mover 374. One or more bearings 390 may be disposed between the floating element 366 and the interior surface 368 of the stationary component 362 to reduce frictional effects between the floating element 366 and the interior surface 368.

The stationary component 360 and the prime mover 374 may include mating threads 392. As such, when the mechanical service tool 12 rotates the prime mover 374, the mating threads 392 between the stationary component 362 and the prime mover 374 may axially move the prime mover 374 (e.g., in the longitudinal 54 direction) along the axial centerline 74 of the casing 40. The prime mover 374 may hence slide the floating element 366 along the interior surface 368 of the stationary component 362. In one embodiment, the mating threads 392 may generate a large linear force on the prime mover 374 with a modest torque input from the mechanical service tool 12. In addition, the mating threads 392 may eliminate or avoid the use of large linear actuators that might otherwise be used to move the floating element 366 in other embodiments.

As set forth above, the flow of wellbore fluids into the casing 40 may be regulated by altering the alignment of the slot 364 within the stationary component 362 and the slot 370 within the floating element 366. For example, if the slots are aligned along a radial 56 centerline, the wellbore fluids may flow into the flow control device 360 and the casing 40 uninhibited. By sliding the floating element 366 longitudinally 54 using the prime mover 374, the area between the slot 364 and slot 370 available for the wellbore fluids to flow through may be choked and/or eliminated completely.

Additionally or alternatively, the flow control device 360 may include a threaded floating element 396, as illustrated in FIG. 32. The threaded floating element 396 may engage directly with the stationary component 362 using the mating threads 392. As such, the mechanical service tool 12 may rotate the threaded floating element 396 to alter the alignment of the slot 364 within the stationary component 362 and a slot 398 within the threaded floating element 396. The one or more bearings 390 may be used to reduce frictional effects between the interior surface 368 of the stationary component 362 and the threaded floating element 396.

Additionally or alternatively, a separate threaded portion 400 may couple to the stationary component 362 using fasteners (e.g., bolts 402), as shown in FIG. 33. A threaded floating element 404 may engage with the threaded portion 400 using the mating threads 392. As such, the cutter tool 12 may rotate the threaded floating element 404 to alter the alignment of the slot 364 within the stationary component 362 and a slot 406 within the threaded floating element 404. The one or more bearings 390 may be used to reduce frictional effects between the interior surface 368 of the stationary component 362 and the threaded floating element 404. The threaded floating element 404 may include a notch 408 that engages with a bolt 402 within the stationary component 362. The notch 408 may thus prevent the threaded floating element 404 from moving past a designated endpoint in the longitudinal direction 54.

Figure 34:
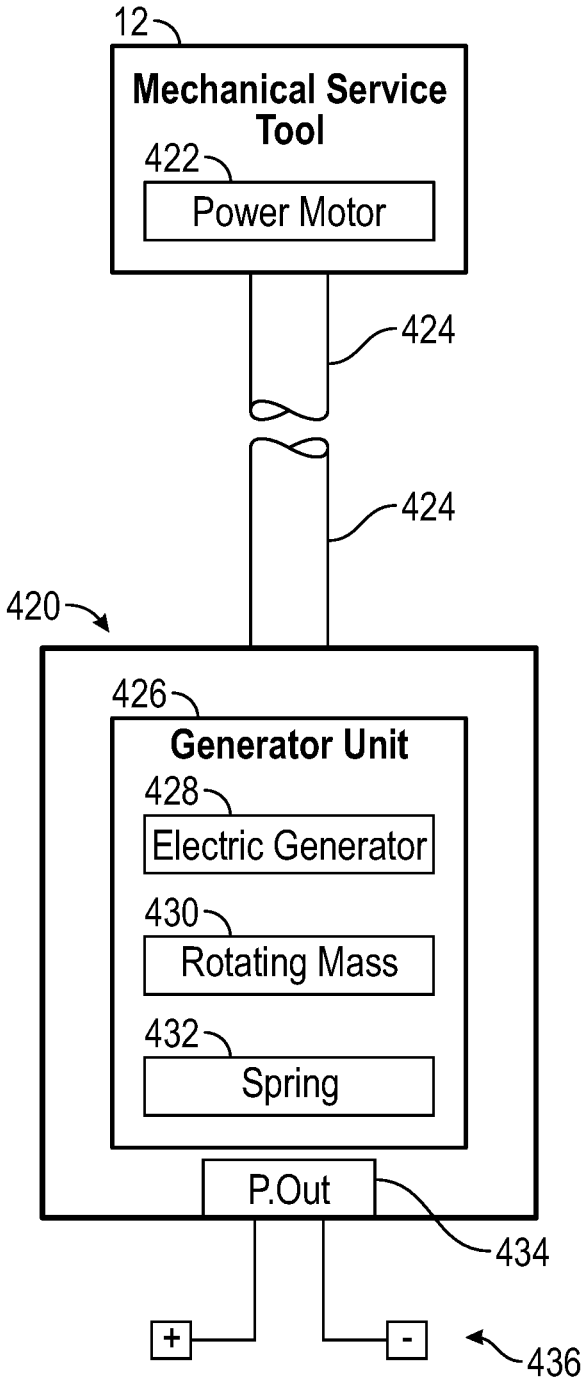
FIG. 34 is a perspective view of a mechanical charging tool that may couple to the mechanical service tool of FIG. 1, in accordance with an embodiment of the present disclosure.

In some situations, it may be desirable to provide energy to sensors or mechanical structures of the mechanical service tool 12, the rotary cutter tool 300, or another downhole tool. Turning now to FIG. 34, a mechanical charging tool 420 may generate electrical energy for downhole tools (e.g., the mechanical service tool 12, the rotary cutter tool 300). The mechanical charging tool 420 may couple, for example, to the mechanical service tool 12, the rotating cutter tool 300, or the cable 18. In one embodiment, the mechanical charging tool 420 may be a component entirely separate of the mechanical service tool 12. The mechanical service tool 12 may include a power motor 422 (e.g., mud motor, hydraulic motor) that may rotate an input shaft 424 coupled to a generator unit 426 of the mechanical charging tool 420.

In one embodiment, the generator unit 426 may include an electric generator 428 that directly converts the rotational energy of the input shaft 424 to electrical energy. In one embodiment, the generator unit 426 may include a rotating mass 430 that is spun and/or accelerated via the input shaft 424. The rotating mass 430 may store rotational kinetic energy. In one embodiment, the rotational kinetic energy of the rotating mass 430 may be used to spin the electric generator 428 while the input shaft 424 may be stationary. Additionally or otherwise, the mechanical charging tool 420 may include a spring 432 that is wound (e.g., coiled helically) using the input shaft 424, similarly to the kinetic energy stored in the rotating mass 430. As such, potential energy may be stored in the spring 432. The spring 432 may be unwound and used to spin the generator 428, such that the generator 428 may generate electrical energy.

In addition, the spring 432 may be compressed linearly to store elastic potential energy. This energy may be stored and released using a mechanical trigger. For example, the elastic potential energy in the spring 432 may be converted to rotational movement using a crank system when the spring 432 expands linearly. As such, the spring 432 may rotate an input shaft of the generator 428 a generate electrical energy. The mechanical charging tool 420 may include a power outlet 434 and output leads 436. The output leads 436 may be coupled to components (e.g., the sensors 112) of the mechanical service tool 12 that may require electrical power.

Figure 35:
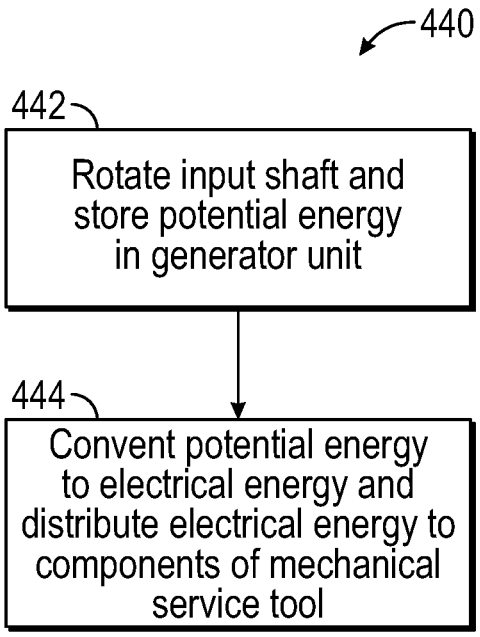
FIG. 35 is a method of operating the mechanical charging tool of FIG. 34, in accordance with an embodiment of the present disclosure.

FIG. 35 illustrates a method 440 that may be used to operate the mechanical charging tool 420. Block 442 of FIG. 35 describes the input of rotational mechanical energy into the mechanical charging tool 420. For example, the input shaft 424 may accelerate the rotating mass 430 within the mechanical charging tool 420 and store rotational potential energy using the inertia of the mass 430. Additionally or otherwise, the input shaft 424 may coil the spring 432 within the mechanical charging tool 420. As such, the mechanical charging tool 420 may store various forms of potential energy.

Block 444 of FIG. 35 describes releasing the stored potential energy and/or converting the stored potential energy to electrical energy that may power components of the mechanical service tool 12. For example, the rotating mass 430 may be used to rotate the generator 428, ergo transforming the rotational kinetic energy of the rotating mass 430 into electrical energy. Similarly, the stored potential energy in the coiled spring 432 may be release when the spring 432 is unwound and used to rotate the generator 428. The generated electricity may be supplied to various components of the mechanical service tool 12 (e.g., the sensors 112) using the output leads 436.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. An impact system of a mechanical service tool, the impact system comprising:

a first shaft configured to be coupled to a driving motor;

a second shaft configured to be coupled to a drilling bit;

an impact weight disposed within a housing;

a spring coupled to the impact weight and the housing, wherein the spring is configured to coil about or compress along an axis; and a hammer mechanism including:

a first hammer coupled to the impact weight, the first hammer having a first plurality of teeth; and a second hammer coupled to the second shaft, the second hammer having a second plurality of teeth that are engageable with the first plurality of teeth, wherein the hammer mechanism is configured to engage the second shaft with the driving motor and disengage the second shaft from the driving motor by selectively engaging the second plurality of teeth with the first plurality of teeth based on coiling action of the spring.

2. The impact system of claim 1, wherein the first shaft extends through an opening of the impact weight, wherein the impact weight is configured to impart an impact axially while a torque is transferred by the first shaft, and wherein the impact weight is configured to retract slower than the impact weight extends to release energy stored axially in the spring.

3. The impact system of claim 1, wherein the impact weight is freely movable in an axial direction.

4. The impact system of claim 3, wherein:

the spring is coupled to the first shaft and configured to provide compressive force to the impact weight; and the impact weight is coupled to the first shaft and configured to store rotational energy.

5. The impact system of claim 3, wherein the impact weight is configured to transmit torque to the second shaft with successive torque spikes by alternatively storing and releasing spring energy.

6. The impact system of claim 1, further comprising sensors configured to measure operational parameters of the driving motor.

7. The impact system of claim 1, further comprising a computer configured to monitor and control operation of the impact system in real time.

8. The impact system of claim 6, further comprising a surface system configured to receive sensor data transmitted from the sensors.

9. A method comprising:

rotating a shaft of an impact system using a driving motor;

winding or compressing a spring about an axis, based on a first plurality of teeth of a first hammer being engaged with a second plurality of teeth of a second hammer, wherein the shaft is disposed within a central portion of the spring;

unwinding or extending the spring about the axis based on the first plurality of teeth becoming disengaged with the second plurality of teeth, wherein the spring is configured to accelerate an impact weight; and decelerating the impact weight, wherein the impact weight is configured to impose a force on a drilling bit.

10. The method of claim 9, wherein the impact weight is configured to release energy in a direction of a drilling bit axis.

11. The method of claim 9, wherein the impact weight is configured to release energy in a rotary manner to provide successive torque spikes.

12. The method of claim 9, further comprising reengaging the first plurality of teeth with the second plurality of teeth, wherein decelerating the impact weight is based on reengaging the first plurality of teeth with the second plurality of teeth.

13. A method, comprising:

engaging a first plurality of teeth of a first hammer with a second plurality of teeth of a second hammer;

rotating a first shaft using a driving motor;

winding a spring based on rotating the first shaft;

moving an impact weight and the first hammer away from the second hammer, based on winding the spring, so as to disengage the first plurality of teeth from the second plurality of teeth;

unwinding the spring based on the first plurality of teeth disengaging from the second plurality of teeth;

accelerating the impact weight toward the second hammer, based on unwinding the spring; and decelerating the impact weight, wherein the impact weight imparts a force to a drill bit based on decelerating the impact weight.

14. The method of claim 13, further comprising rotating the impact weight concurrent with accelerating the impact weight, wherein the force imparted by the impact weight to the drill bit includes a linear impact force and a rotational torque.

15. The method of claim 13, further comprising reengaging the first plurality of teeth with the second plurality of teeth.

16. The method of claim 15, wherein:

engaging the first plurality of teeth with the second plurality of teeth comprises engaging a first tooth of the first plurality of teeth with a first tooth of the second plurality of teeth; and reengaging the first plurality of teeth with the second plurality of teeth comprises engaging the first tooth of the first plurality of teeth with a second tooth of the second plurality of teeth that is different than the first tooth of the second plurality of teeth.

17. The method of claim 13, wherein decelerating the impact weight comprises the first hammer impacting the second hammer.

18. The method of claim 17, further comprising reengaging the first plurality of teeth with the second plurality of teeth based on the first hammer impacting the second hammer.

19. The method of claim 17, wherein the impact weight imparts a linear impact force and a rotational torque to the drill bit via impact of the first hammer with the second hammer.

* * * * *